US012441500B2

(12) United States Patent
Ghiotti et al.

(10) Patent No.: US 12,441,500 B2
(45) Date of Patent: Oct. 14, 2025

(54) FORMING UNIT AND FORMING METHOD TO MANUFACTURE A GROUP OF ARTICLES

(71) Applicant: SASIB S.P.A., Castel Maggiore (IT)

(72) Inventors: Roberto Ghiotti, Monte S. Pietro (IT); Yuri Negrini, Bologna (IT)

(73) Assignee: SASIB S.P.A., Castel Maggiore (IT)

( * ) Notice: Subject to any disclaimer, the term of this patent is extended or adjusted under 35 U.S.C. 154(b) by 0 days.

(21) Appl. No.: 18/561,911

(22) PCT Filed: Jun. 3, 2022

(86) PCT No.: PCT/IB2022/055193

§ 371 (c)(1),
(2) Date: Nov. 17, 2023

(87) PCT Pub. No.: WO2022/254393

PCT Pub. Date: Dec. 8, 2022

(65) Prior Publication Data

US 2024/0246708 A1 Jul. 25, 2024

(30) Foreign Application Priority Data

Jun. 3, 2021 (IT) ..... 102021000014411

(51) Int. Cl.
*B65B 35/40* (2006.01)
*A24F 15/01* (2020.01)
(Continued)

(52) U.S. Cl.
CPC ..... *B65B 35/40* (2013.01); *A24F 15/01* (2020.01); *A24F 15/20* (2013.01); *B65B 19/20* (2013.01);
(Continued)

(58) Field of Classification Search
CPC ..... B65B 35/40; B65B 35/32; B65B 35/52; B65B 19/20; B65B 43/52; B65B 2230/04; A24F 15/01; A24F 15/20
(Continued)

(56) References Cited

U.S. PATENT DOCUMENTS 2,682,983 A * 7/1954 Ashcroft ..... B65B 43/48 221/124
3,771,279 A * 11/1973 Seragnoli ..... B65B 19/10 53/151
(Continued)

OTHER PUBLICATIONS

International Application No. PCT/IB2022/055193, International Search Report and Written Opinion, mailed Sep. 16, 2022.

*Primary Examiner* — Dariush Seif
(74) *Attorney, Agent, or Firm* — MARSHALL, GERSTEIN & BORUN LLP

(57) ABSTRACT

Forming unit (A) and forming method to manufacture a group of articles (14), wherein the articles (14) are arranged at a given distance from one another. The following are provided: a forming conveyor (26) which moves at least one forming box (27) along a forming path (P2): a hopper (24), which is arranged along the forming path (P2) and is provided with at least one output mouth (25) comprising a plurality of dividing walls (31) defining channels (32), each configured to contain a vertical stack of articles (14); and an extractor (29), which is configured to extract the group of articles (14) from the channels (32) of the output mouth (25) and to insert the group into the forming box (27) by means of a work stroke, which is perpendicular to the forming path (P2). The forming box (27) has aa plurality of through holes (28) with a cylindrical shape, each being separate from and independent of the other through holes ((2288)) and being designed to house a corresponding single article (14) of the group.

14 Claims, 19 Drawing Sheets

(51) Int. Cl.

| | |
|---|---|
| ***A24F 15/20*** | (2006.01) |
| ***B65B 19/20*** | (2006.01) |
| ***B65B 35/32*** | (2006.01) |
| ***B65B 35/52*** | (2006.01) |
| ***B65B 43/52*** | (2006.01) |

(52) U.S. Cl.
CPC ..... *B65B 35/32* (2013.01); *B65B 35/52* (2013.01); *B65B 43/52* (2013.01); *B65B 2230/04* (2013.01)

(58) Field of Classification Search
USPC ..... 53/473
See application file for complete search history.

(56) References Cited

U.S. PATENT DOCUMENTS 3,924,386 A * 12/1975 Schermund ..... B65B 19/223 53/236
4,233,799 A * 11/1980 Caille ..... B65B 19/34 53/154
4,306,648 A * 12/1981 Manservisi ..... B65B 19/10 53/151
4,376,484 A * 3/1983 Seragnoli ..... B65B 19/30 209/535
4,528,801 A * 7/1985 Seragnoli ..... B65B 19/32 53/151
4,693,374 A * 9/1987 Dall'Osso ..... A24C 5/345 209/535
4,700,825 A * 10/1987 Mattei ..... B65B 19/10 53/151
4,793,478 A * 12/1988 Tudor ..... A24F 15/20 206/256
5,540,034 A * 7/1996 Focke ..... B65B 19/20 53/475
5,548,941 A * 8/1996 Portaro ..... B65B 19/04 53/151
5,558,216 A * 9/1996 Focke ..... B65D 85/1045 206/256
5,938,017 A * 8/1999 Wik ..... A24F 15/20 206/256
6,484,867 B2 * 11/2002 Spatafora ..... B65B 19/10 131/282
6,612,094 B1 * 9/2003 Bailey ..... B65B 5/024 53/563
7,827,767 B2 * 11/2010 Bertuzzi ..... B65B 19/30 53/148
2001/0003891 A1 * 6/2001 Meis ..... B65B 19/10 53/148
2007/0006888 A1 * 1/2007 Hicks ..... B26D 3/161 131/70
2008/0006284 A1 * 1/2008 Barnes ..... A24C 5/12 131/58
2009/0038630 A1 * 2/2009 Bertuzzi ..... B65B 63/005 131/283
2023/0075912 A1 * 3/2023 Polloni ..... A24F 15/01
2024/0246708 A1 * 7/2024 Ghiotti ..... B65B 35/40

* cited by examiner

FORMING UNIT AND FORMING METHOD TO MANUFACTURE A GROUP OF ARTICLES

CROSS-REFERENCE TO RELATED APPLICATIONS

This Patent Application is a U.S. national stage of International Application No. PCT/IB2022/055193, filed Jun. 3, 2022, which claims priority from Italian Patent Application No. 102021000014411 filed Jun. 3, 2021, the entire disclosure of which is incorporated herein by reference.

TECHNICAL FIELD OF THE INVENTION

The present invention relates to a forming unit and to a forming method to manufacture a group of articles.

In particular, the present invention relates to the tobacco field in the case in which the articles are smoking articles, in particular rod-shaped ones. Alternatively, the present invention could be applied to the pharmaceutical or cosmetic field in the case in which the articles are containers, such as for example vials, bottles or syringes, containing pharmaceutical or cosmetic products. As a further alternative, the present invention could be applied to the packaging field in general in the case in which the articles are generic articles preferably having a longitudinal development.

STATE OF THE ART

Traditionally, in the tobacco field, a rigid pack of cigarettes comprises a group of cigarettes in direct contact with one another (and normally arranged in three layers made up of seven, six and seven cigarettes, respectively), a wrap that completely wraps the group of cigarettes, and a container which is provided with a hinged lid and houses the wrap that wraps the group of cigarettes on the inside thereof. In a traditional pack of this type, the extraction of the first cigarette is relatively simple (despite the fact that the cigarettes are in close contact with one another and even slightly pressed against each other) as the cigarettes are easily and widely elastically deformable and therefore it is possible to "create", with the fingers, the space to extract (remove) the first cigarette from the group of cigarettes. However, a traditional pack of this type is not designed to contain rigid (namely, non-deformable) cartridges for new generation cigarettes (for example electronic cigarettes), as the rigid cartridges are not elastically deformable (for example because they are enclosed in a cylindrical casing made of plastic or metal) it becomes extremely complex (if not impossible) to extract the first rigid cartridge without damage.

To overcome this drawback, rigid packs of rod-shaped smoking articles have been proposed, for example of the type described in patent applications WO2017013741A1, WO2017013742A1; a rigid pack of this type comprises a group of smoking articles, a container that is provided with a hinged lid and houses the group of smoking articles on the inside thereof, and a support system that is arranged inside the container and defines a series of seats each designed to contain a single smoking article while keeping the smoking article separate and at a given distance from the adjacent smoking articles. In this way it is easy to grip each smoking article (as it is spaced from the adjacent smoking articles) in order to extract the smoking article from the pack. According to some embodiments, the support system comprises at least one wall which is arranged parallel to a bottom wall of the container, is arranged perpendicular to the smoking articles (namely, to the longitudinal axis of the smoking articles), and has a plurality of through holes each engaged by a corresponding smoking article to define a given and predetermined position for the smoking article.

However, conventional packaging machines cannot be used to manufacture a rigid pack of smoking articles where smoking articles are spaced apart from one another, as conventional packing packaging machines are configured to handle only groups of compact smoking articles in which the smoking articles are in close contact with one another and therefore can be treated as if they were a single monolithic body.

Packs of the type described in documents WO2017013741A1 and WO2017013742A1 are also known for containing articles of the pharmaceutical or cosmetic field, such as vials, bottles or syringes, containing pharmaceutical or cosmetic products. In this case the problems are the same as described above with reference to the tobacco field.

SUBJECT AND SUMMARY OF THE INVENTION

The purpose of the present invention is to provide a forming unit and a forming method to manufacture a group of articles, in which the articles are spaced apart from one another.

According to the present invention, a forming unit and a forming method are provided to manufacture a group of articles and a respective manufacturing method, as claimed in the attached claims.

The claims also form an integral part of the present description.

BRIEF DESCRIPTION OF THE DRAWINGS

The present invention will now be described with reference to the attached drawings, which illustrate a non-limiting embodiment thereof, wherein.

DETAILED DESCRIPTION OF PREFERRED EMBODIMENTS OF THE INVENTION

Figure 1:
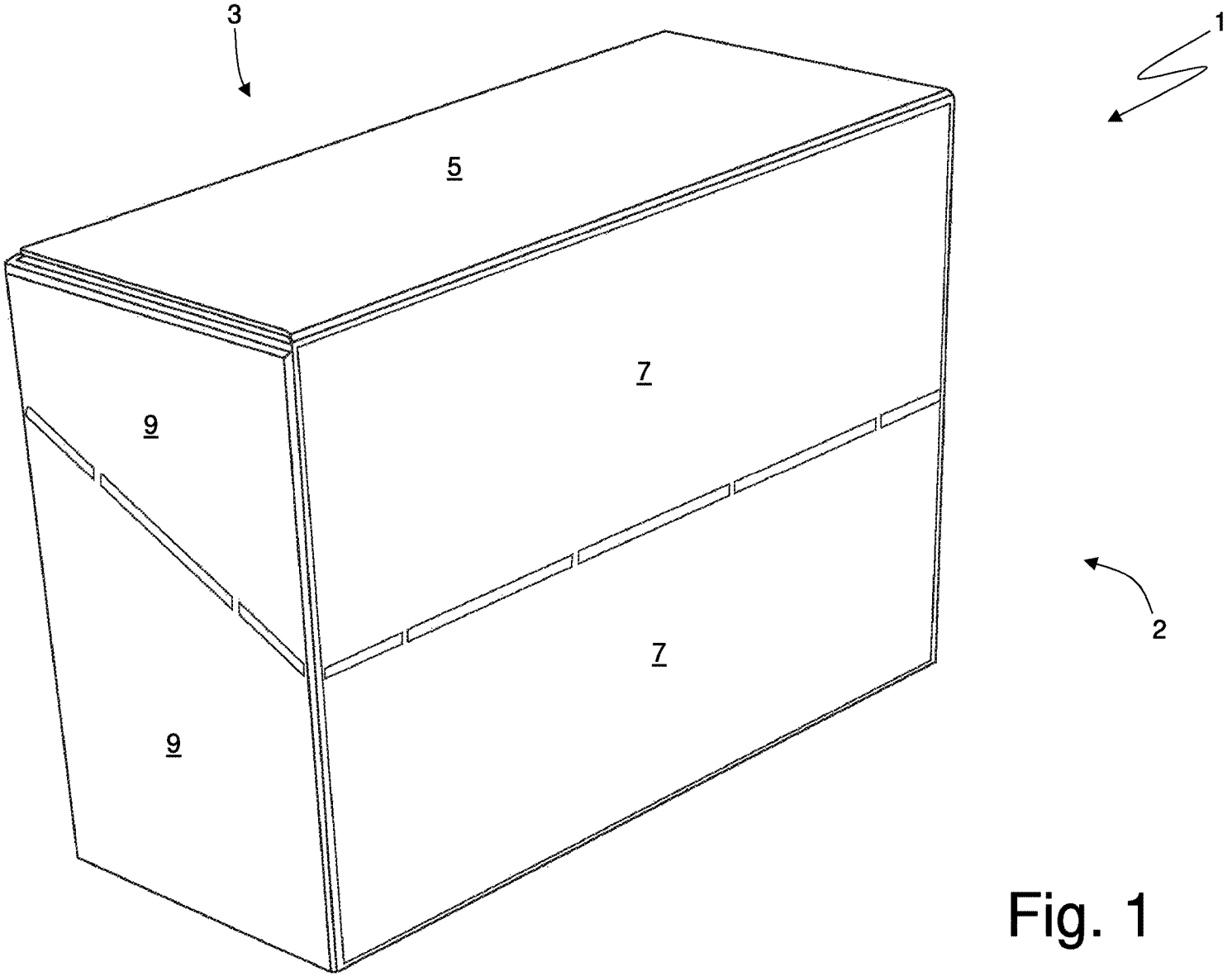
FIG. 1 is a front perspective view and in a closed configuration of a rigid pack of smoking articles manufactured according to the present invention.
Figure 2:
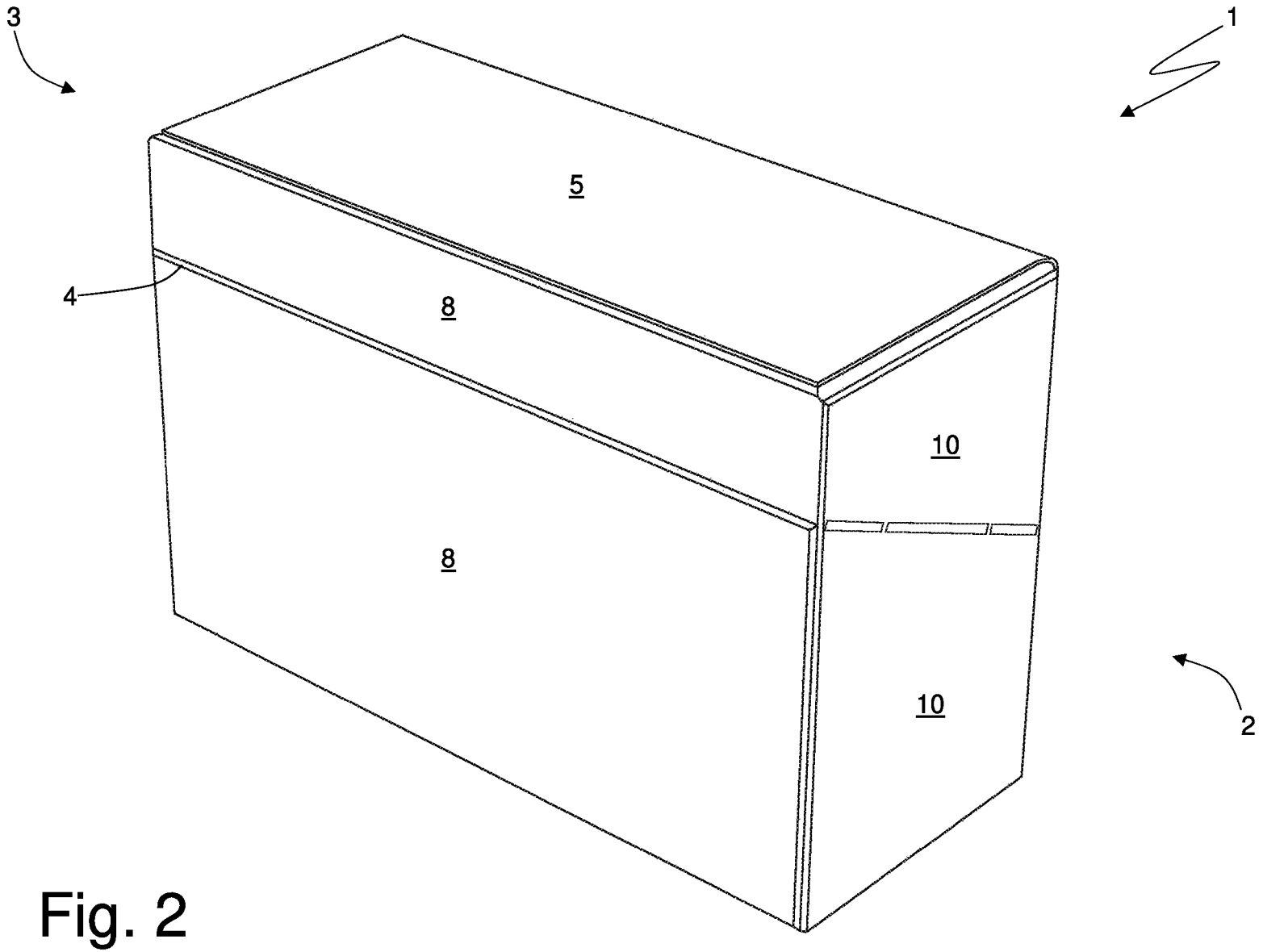
FIG. 2 is a rear perspective view of the pack of FIG. 1 in a closed configuration.
Figure 3:
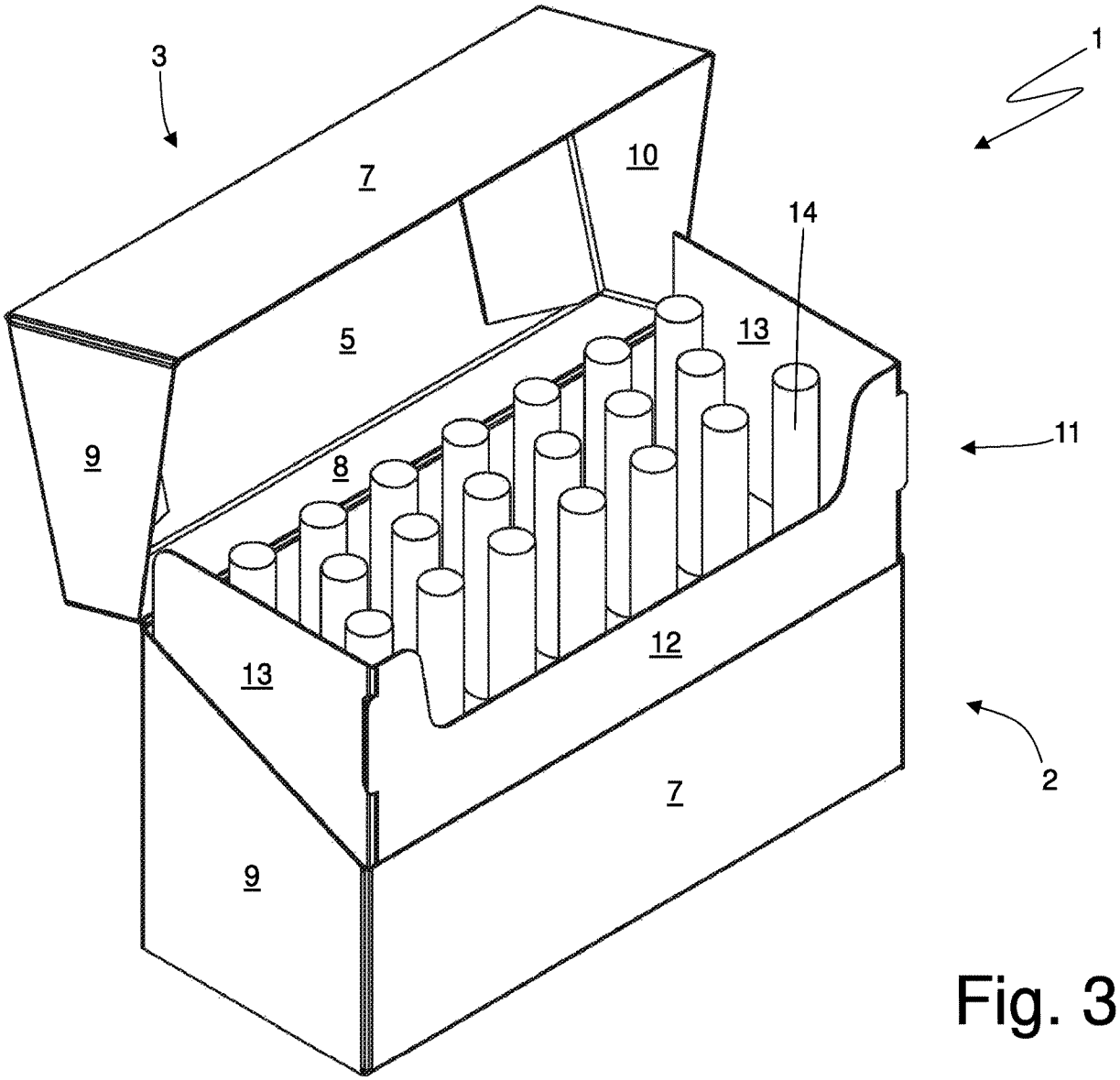
FIG. 3 is a front perspective view of the pack of FIG. 1 in an open configuration.

In FIGS. 1, 2 and 3 number 1 denotes as a whole a rigid pack of smoking articles.

In the following discussion specific reference will be made to rod-shaped smoking articles. It should be noted that the proposed forming unit and method to manufacture a group of articles object of the present invention can be used with articles different from smoking articles. In particular, the proposed forming unit and method can be used with articles of the pharmaceutical and/or cosmetic field, in particular containers such as vials, bottles, cartridges or syringes.

Therefore, in the following of the present description specific reference will be made to smoking articles but in a non-limiting way and without losing generality.

The pack 1 comprises a parallelepiped-shaped container 2 which is made of cardboard or rigid paperboard and is provided with a box-like lid 3 hinged along a hinge 4 (illustrated in FIG. 2) so as to rotate between an opening position (illustrated in FIG. 3) and a closing position (illustrated in FIGS. 1 and 2).

The container 2 has a substantially rectangular parallelepiped shape and has an upper wall 5 (which belongs completely to the lid 3), a lower wall 6 opposite the upper wall 5, a front wall 7 (partly belonging to the lid 3) and a rear wall 8 (partly belonging to the lid 3 and where the hinge 4 is obtained) parallel and opposite to one another, and two side walls 9 and 10 (partly belonging to the lid 3) parallel and opposite to one another.

As illustrated in FIG. 3, the pack 1 comprises, furthermore, a rigid collar 11, which is connected (by gluing) folded into a "U" shape inside the container 2 to partially protrude outside an open upper end of the container 2 and to engage a corresponding inner surface of the lid 3 when the lid 3 is arranged in the closing position. The collar 11 comprises a front wall 12 glued (obviously underneath the lid 3) to the front wall 7 of the container 2 and two side walls 13 glued (obviously underneath the lid 3) to the side walls 9 and 10 of the container 2.

The pack 1 comprises a group of rod-shaped smoking articles 14 (e.g., rigid cartridges for electronic cigarettes or cigarettes), each shaped as an elongated cylinder (namely, having a cross-sectional diameter much smaller a than longitudinal extension). In the embodiment illustrated in FIGS. 1-5, the group is formed by twenty smoking articles 14 arranged on three layers made up of seven, six and seven smoking articles 14, respectively. In the alternative embodiment illustrated in FIG. 6, the group is formed by of twenty smoking articles 14 arranged on two layers each made up of ten smoking articles 14.

Figure 4:
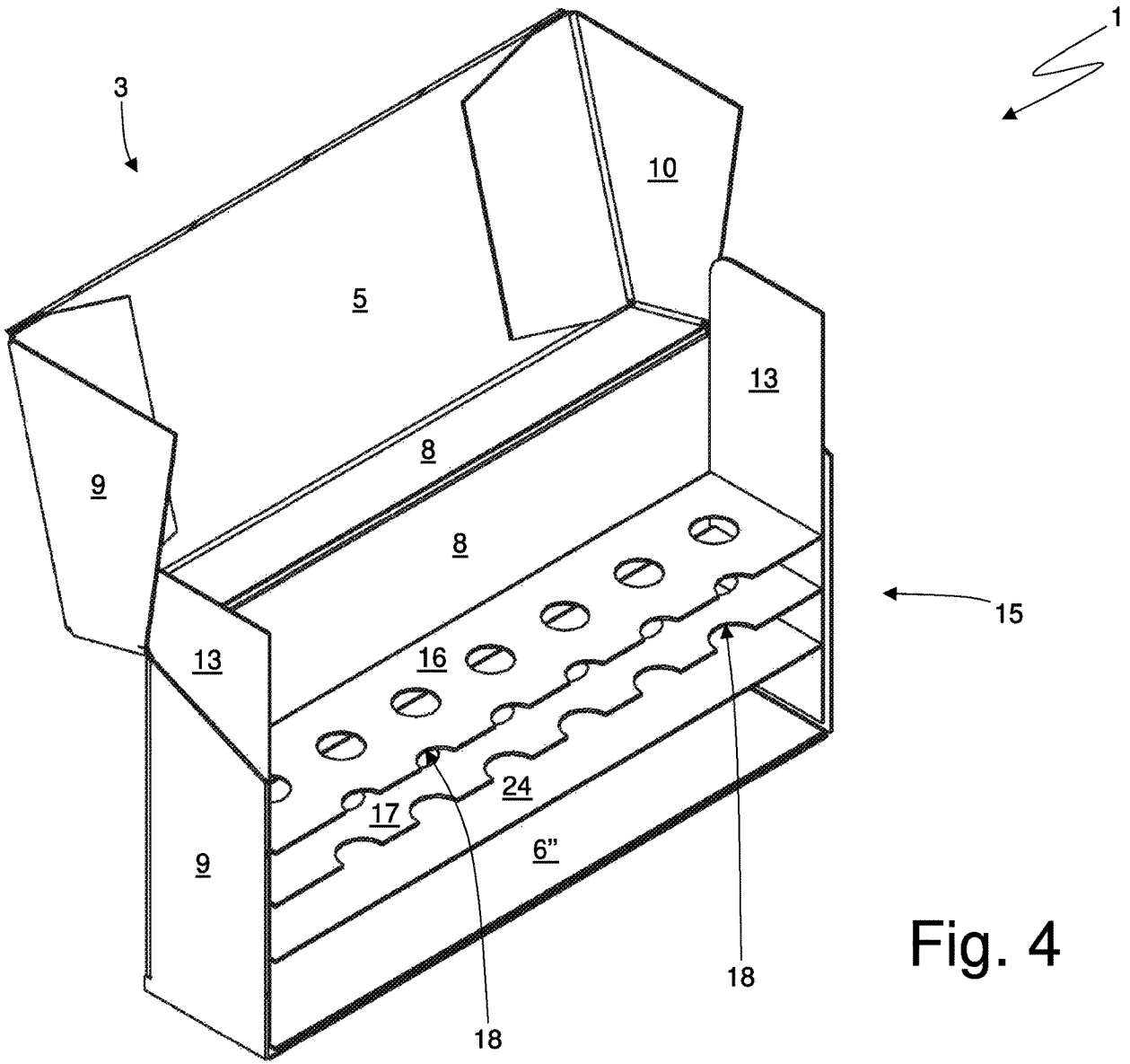
FIGS. 4 and 5 are two different perspective and longitudinal section views of the pack of FIG. 1 in a closed configuration and with the removal of the smoking articles for clarity.
Figure 5:
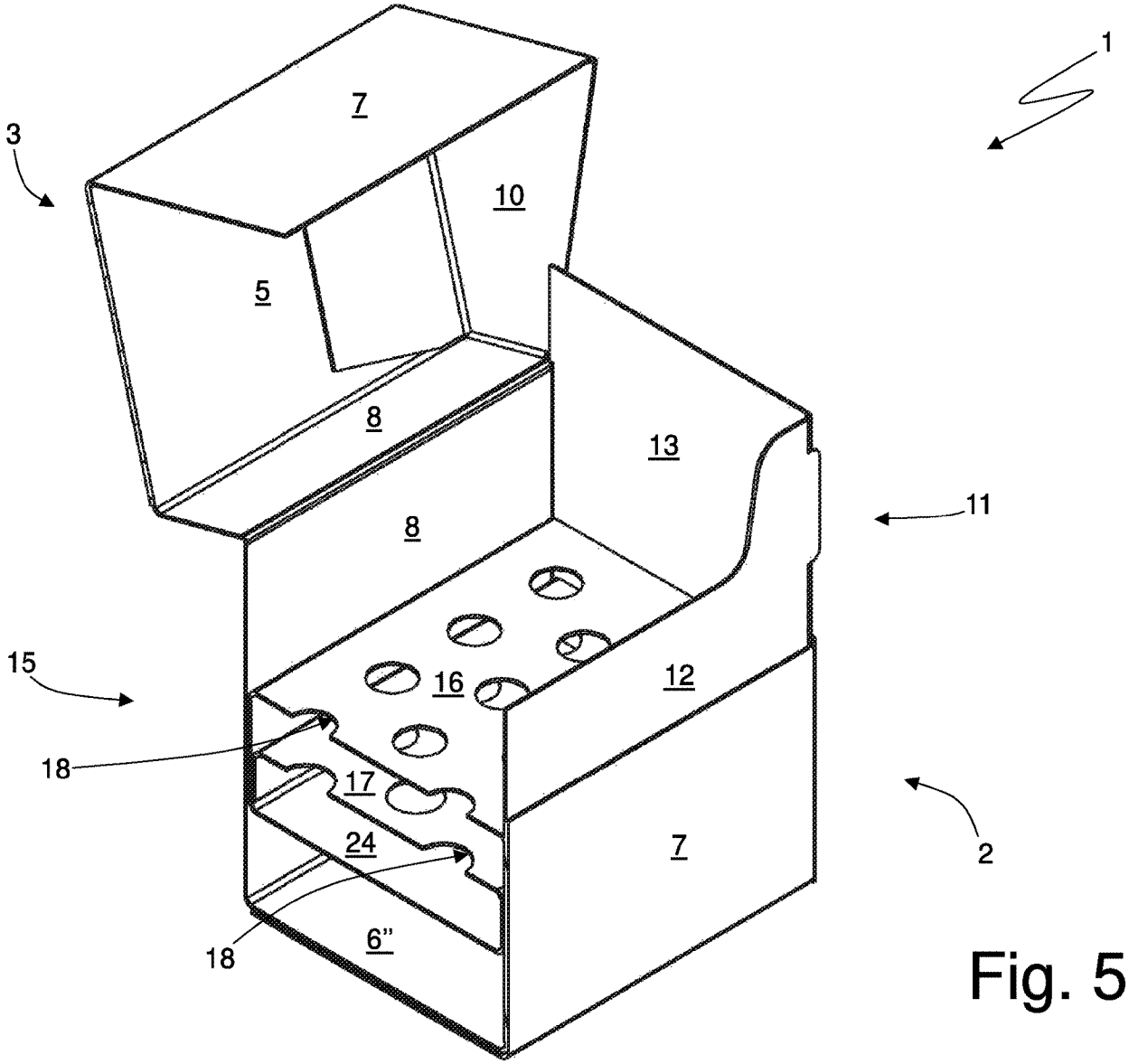

According to what is better illustrated in FIGS. 4 and 5, the pack 1 comprises a support system 15 which is arranged inside the container 2 and defines a series of seats each designed to contain a single smoking article 14 while maintaining the smoking article 14 separate and at given distance from the adjacent smoking articles 14. In this way it is simple to grip each smoking article 14 (as it is spaced from the adjacent smoking articles 14) in order to extract the smoking article 14 from the pack 1. The support system 15 comprises two containment walls 16 and 17 which are arranged at a given distance from one another and are parallel to the upper wall 5 and to the lower wall 6 of the container 2, they are arranged perpendicularly to the smoking articles 14 (namely, to the longitudinal axis of the smoking articles 14), and have a plurality of through holes 18, each engaged by a corresponding smoking article 14 in order to define a given and predetermined position of the smoking article 14. The set of two holes 18 aligned with one another defines a seat for a corresponding smoking article 14; that is, a smoking article 14 that engages two holes 18 aligned with one another, of the two containment walls 16 and 17, is in a predetermined and stable position inside the container 2.

According to a different embodiment, the support system 15 comprises a single containment wall 16 or the support system 15 comprises three or more containment walls 16 and 17.

Figure 7:
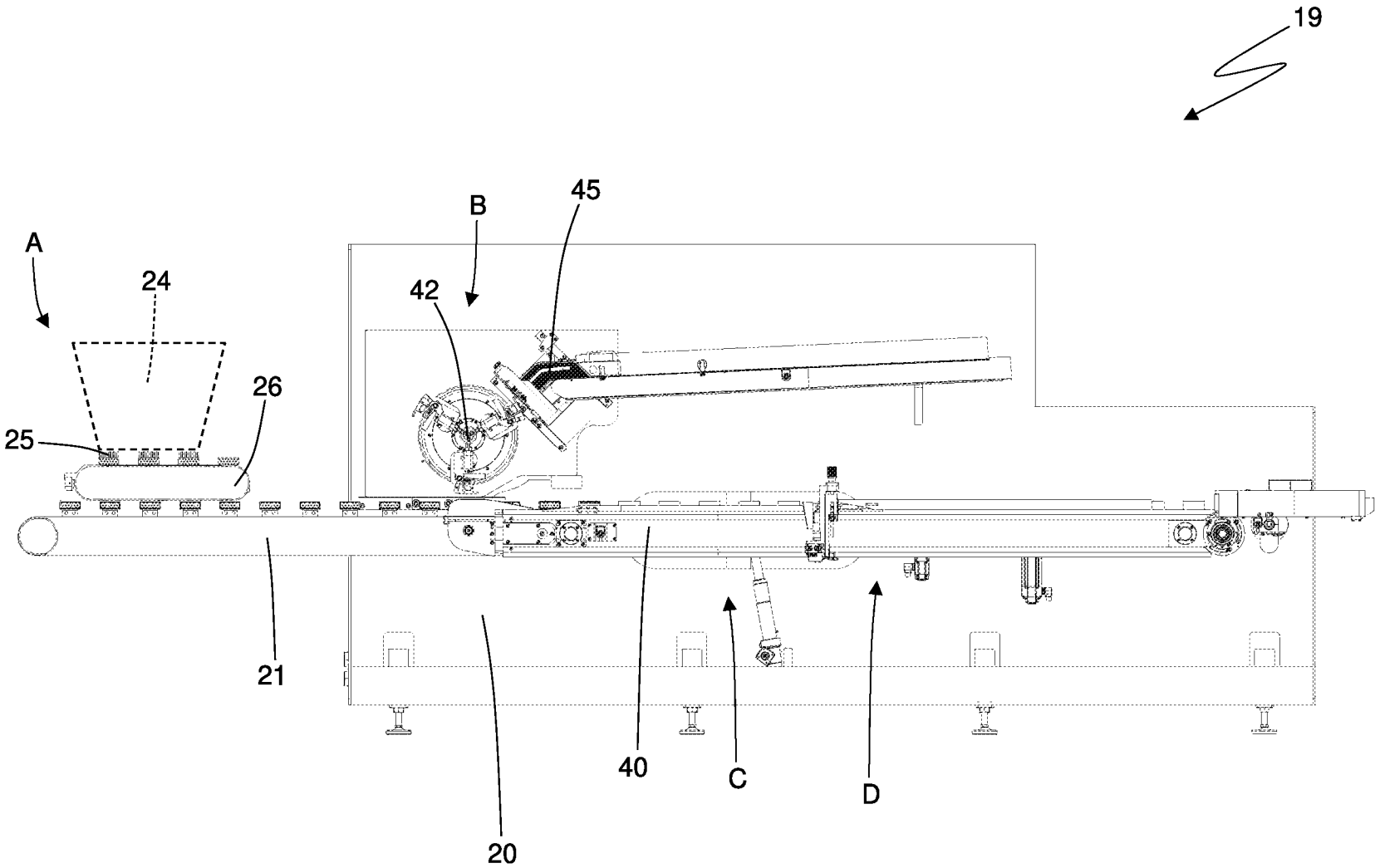
FIG. 7 is a front view and with the elimination of parts for clarity of a packing machine to manufacture the pack of FIG. 1.

In FIG. 7, the reference number 19 denotes as a whole a packing machine to manufacture the pack 1 of smoking articles described above.

The packing machine 19 comprises a frame 20 which rests on the ground and supports: a forming unit A where the groups of smoking articles 14 are formed, a wrapping unit B where the empty and open containers 2 (namely, having the lid 3 in the opening position) are manufactured, an insertion unit C where the groups of smoking articles 14 are inserted into the corresponding containers 2, and finally a closing unit D where the lids 3 of the containers 2 are closed, thus ending the production of the packs of cigarettes 1.

The packing machine 19 comprises a wrapping conveyor 21 (better illustrated in FIG. 8), which moves along a straight and horizontal wrapping path P1 a plurality of wrapping boxes 22 each designed to support a group of smoking articles 14. According to a preferred embodiment illustrated in the attached figures, the wrapping conveyor 21 is a belt conveyor and comprises two parallel and spaced conveyor belts which are looped around respective pairs of end pulleys and support the wrapping boxes 22 at opposite ends.

Figure 9:
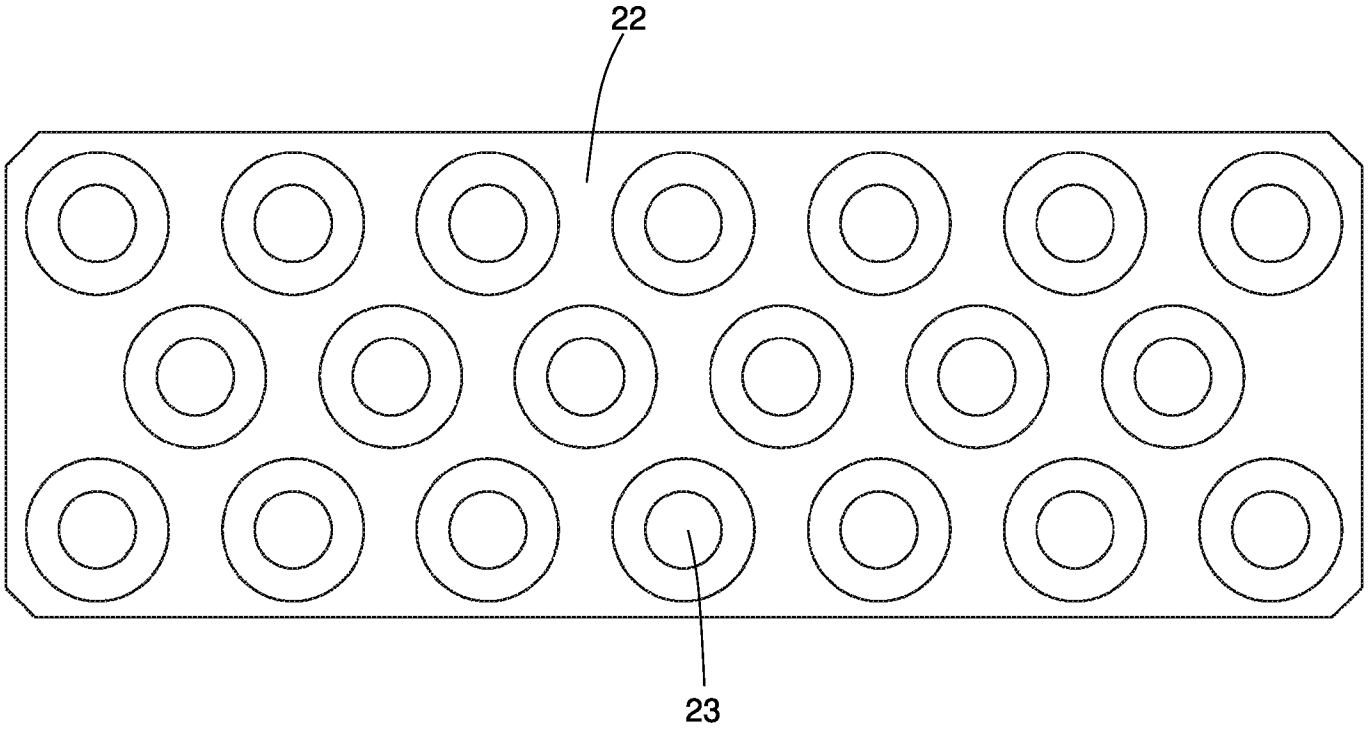
FIG. 9 is a front view of a wrapping box of a wrapping conveyor of the packing machine of FIG. 7.
Figure 10:
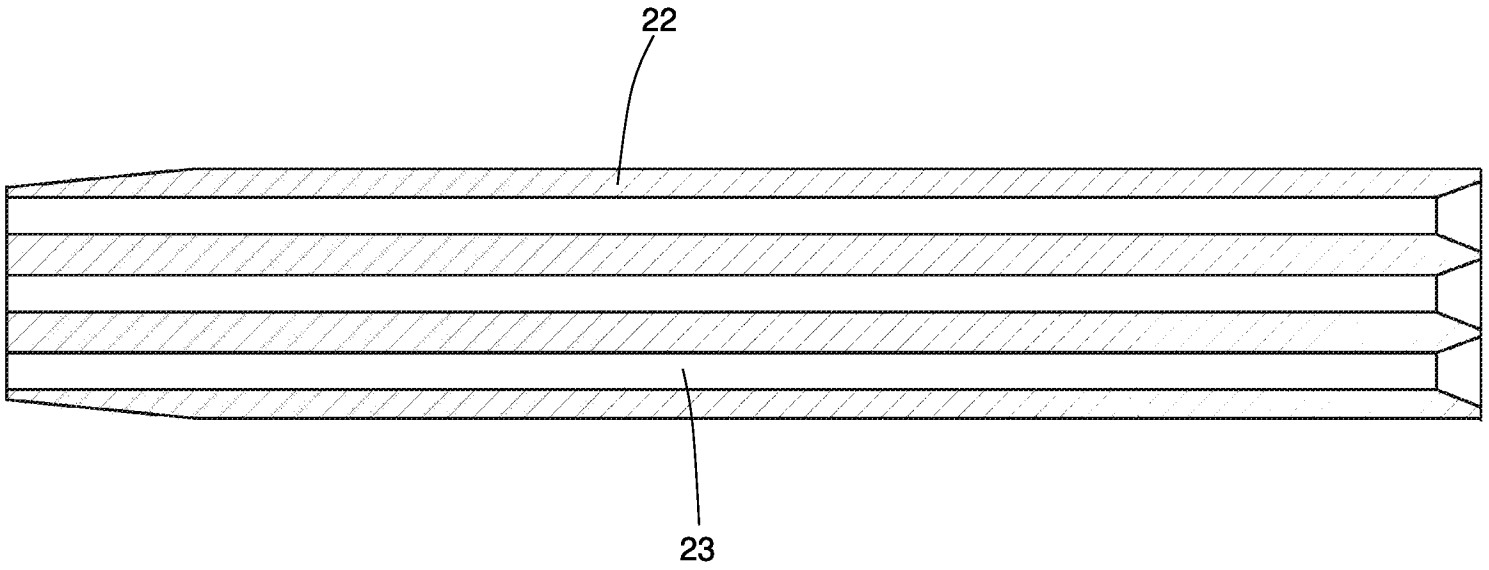
FIG. 10 is a longitudinal sectional view of the wrapping box of FIG. 9.

As illustrated in FIGS. 9 and 10, each wrapping box 22 comprises a parallelepiped shaped body where a plurality of through holes 23 are formed, each designed to receive and house a single corresponding smoking article 14; the through holes 23 are arranged to exactly reproduce the arrangement of the group of smoking articles 14, namely, the distances between the through holes 23 are the same distances between the smoking articles 14 of the group of smoking articles 14. Preferably, in the area of an input side (namely, at the side where the smoking articles 14 enter the through holes 23), the through holes 23 have an initial flared portion (frusto-conical) having a progressively decreasing diameter; in this way, at the input side, the through holes 23 are "self-centring", that is, they are able to guide towards the correct position any smoking article 14 that is trying to enter a through hole 23 starting from a (slightly) off-centre position.

Figure 8:
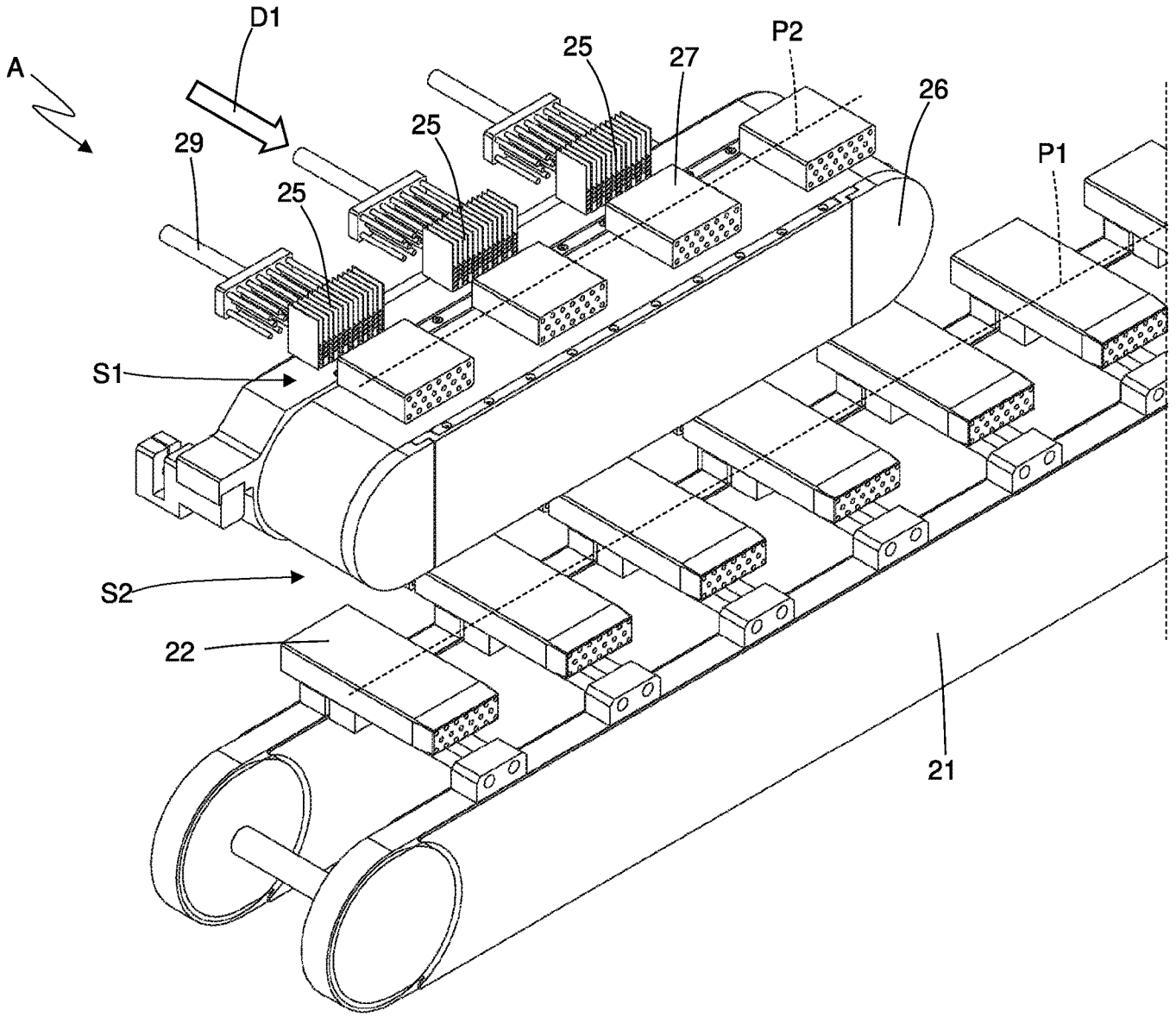
FIG. 8 is a perspective view and with the elimination of parts for clarity of a forming unit of the packing machine of FIG. 7.

As illustrated in FIG. 7, the forming unit A for forming groups of smoking articles 14 comprises a hopper 24 provided with three output mouths 25 (better illustrated in FIG. 8) and a forming conveyor 26. As illustrated in FIG. 8, the forming conveyor 26 moves along a U-shaped forming path P2 a plurality of forming boxes 27 each designed to support a group of smoking articles 14. The forming path P2 is "U" shaped and has an upper rectilinear portion (illustrated in FIG. 8) which extends through an input station S1 at the three output mouths 25 of the hopper 24 and a lower rectilinear portion (not illustrated in FIG. 8) which extends parallel to the wrapping path P1 through a transfer station S2; the two rectilinear sections of the forming path P2 are connected to one another by way of a curved section (not illustrated in FIG. 8) shaped as a semicircle. In the input station S1 three groups of smoking articles 14 are transferred from the three output mouths 25 of the hopper 24 to three corresponding forming boxes 27 of the forming conveyor 26, while in the transfer station S2 three groups of smoking articles 14 are transferred from three corresponding forming boxes 27 of the forming conveyor 26 to corresponding wrapping boxes 22 of the wrapping conveyor 21.

According to a preferred embodiment illustrated in the attached figures, the forming conveyor 26 is a belt conveyor and comprises a conveyor belt which is looped around a pair of end pulleys and supports the forming boxes 27.

Figure 12:
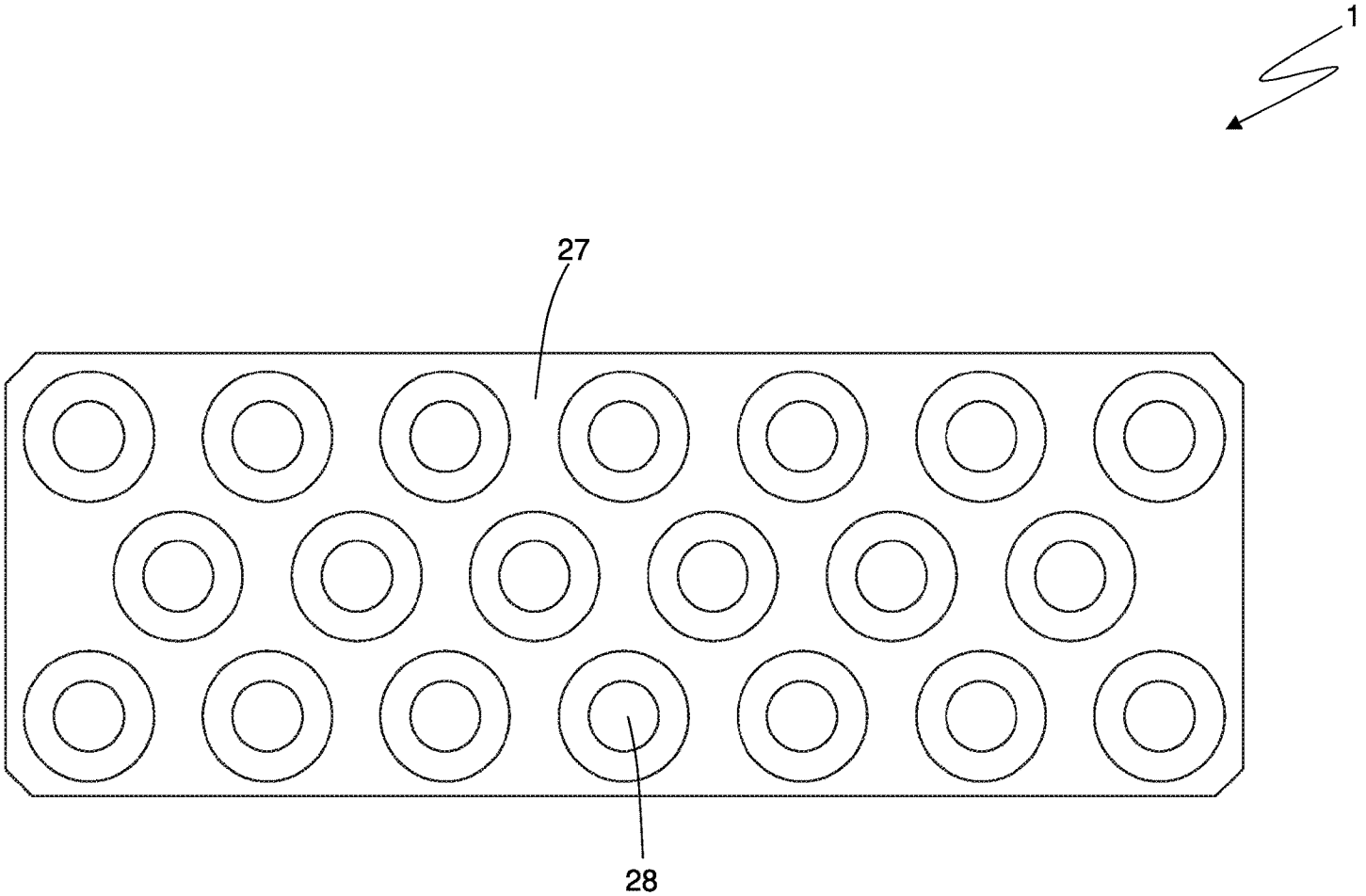
FIG. 12 is a front view of a forming box of the forming unit of FIG. 8.
Figure 13:
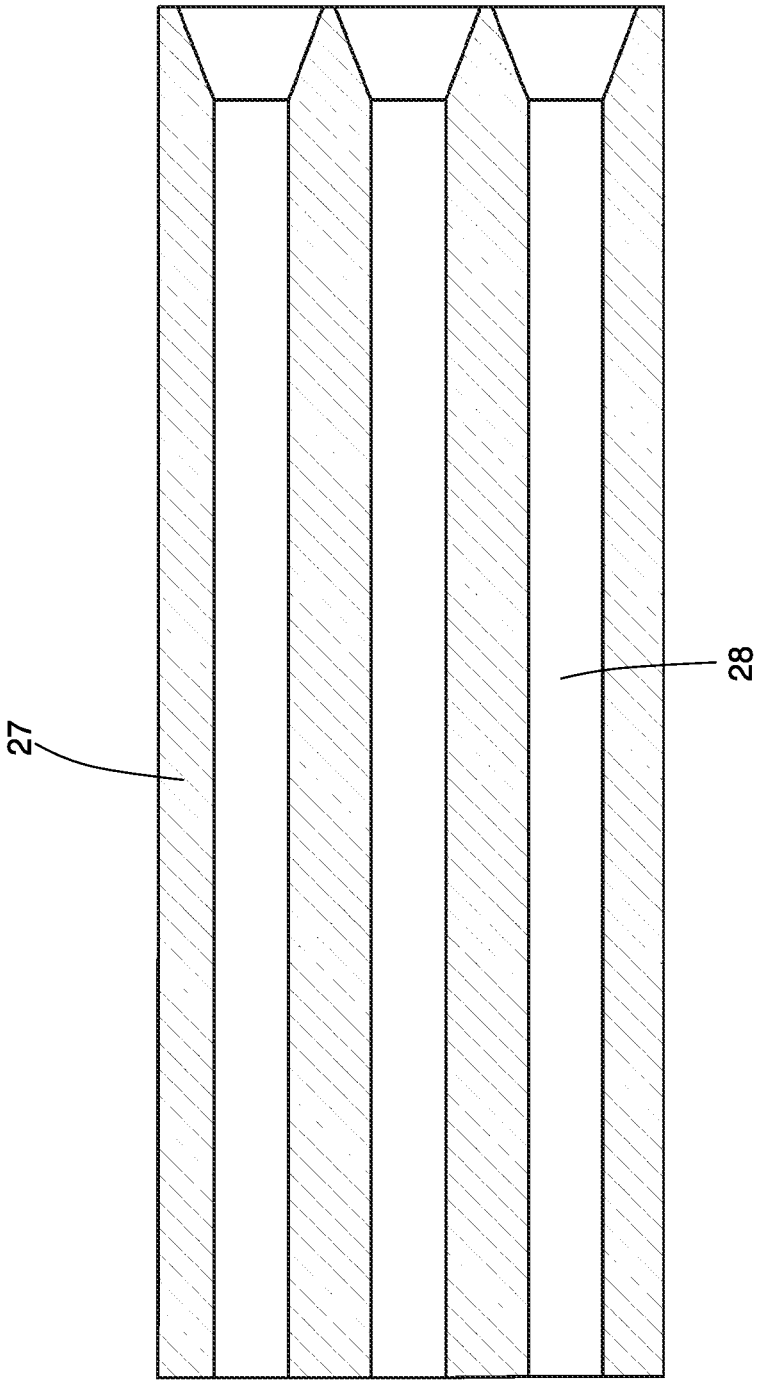
FIG. 13 is a longitudinal sectional view of the forming box of FIG. 12.

As illustrated in FIGS. 12 and 13, each forming box 27 comprises a parallelepiped body where a plurality of through holes 28 are formed, each designed to receive and house a single corresponding smoking article 14; the through holes 28 are arranged to exactly reproduce the arrangement of the group of smoking articles 14, namely, the distances between the through holes 28 are the same distances between the smoking articles 14 of the group of smoking articles 14. Preferably, at an input side (namely, at the side where the smoking articles 14 enter the through holes 28), the through holes 28 have an initial flared portion (frusto-conical) having a progressively decreasing diameter; in this way, at the input side, the through holes 28 are "self-centering", that is, they are able to guide towards the correct position any smoking article 14 that is trying to enter a through hole 28 starting from a (slightly) off-centre position.

As illustrated in FIG. 8, the forming unit A comprises three extractors 29, each configured to extract a group of smoking articles 14 from a corresponding output mouth 25 and subsequently insert the group of smoking articles 14 into a corresponding forming box 27 by means of a work stroke perpendicular to the forming path P2. That is, an actuator device 30 is provided (schematically illustrated in FIG. 16) which imparts an alternating movement along an extraction direction D1 perpendicular to the forming path P2 to the three extractors 29; in particular, the linear movement of the three extractors 29 alternates a work stroke, in which the extractors 29 enter the output mouths 25 to extract respective groups of smoking articles 14 which are subsequently inserted into respective forming boxes 27 stopped in front of the hopper 24, and a return stroke, in which the extractors 29 return back to the initial position.

Figure 11:
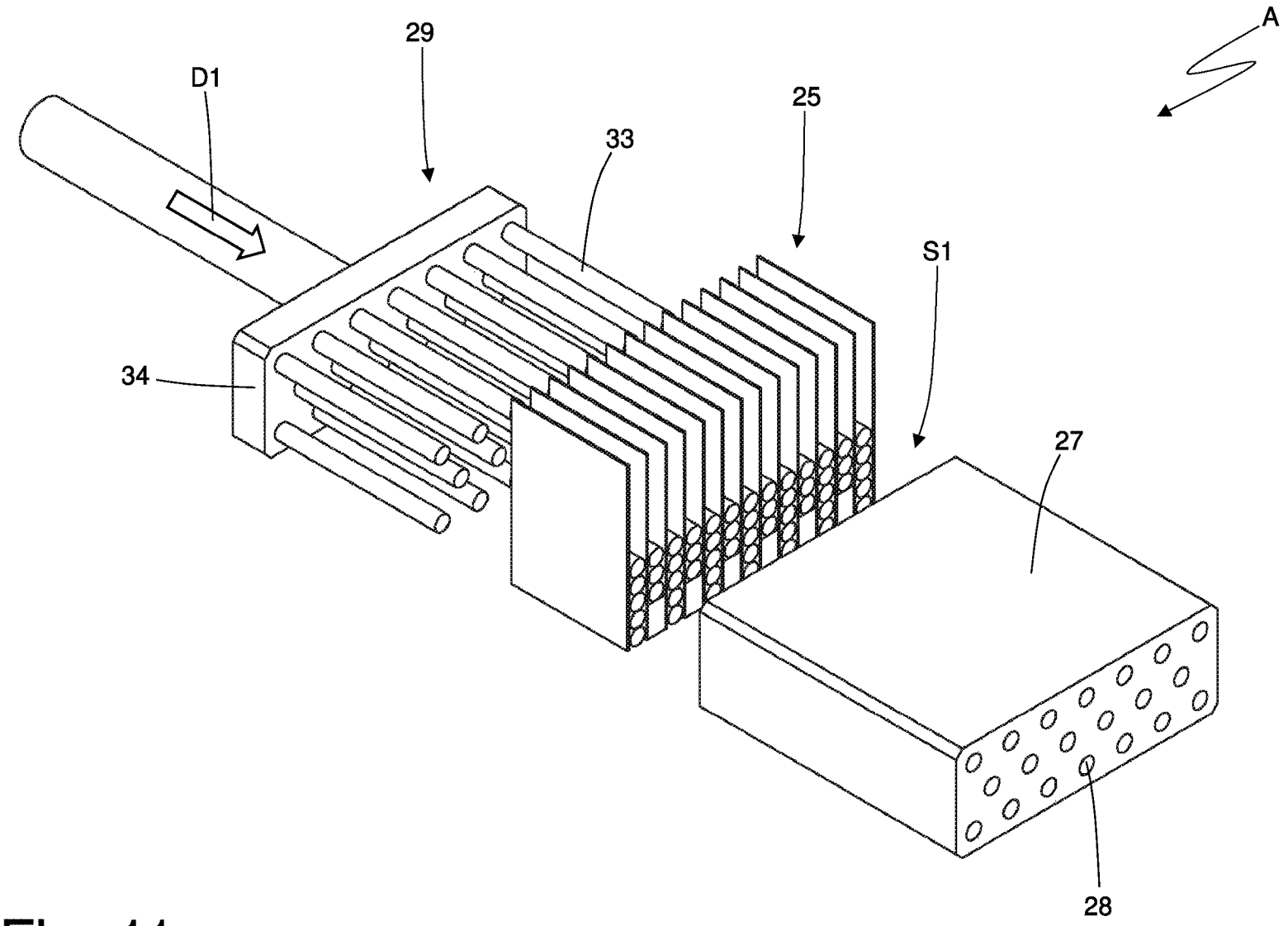
FIG. 11 is a perspective view of a detail of the forming unit of FIG. 8.
Figure 14:
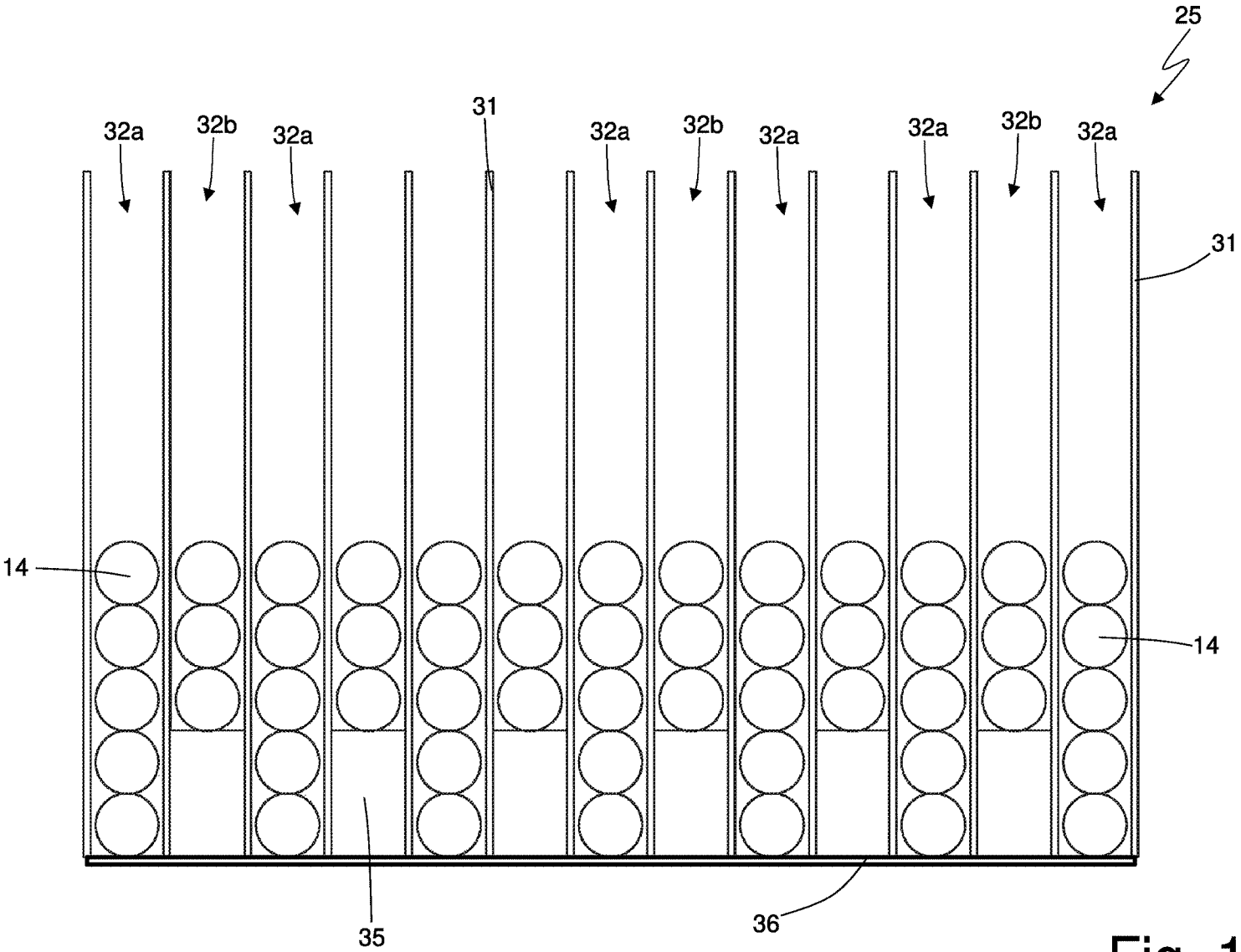
FIG. 14 is a front view of an output mouth of a hopper of the forming unit of FIG. 8.

As better illustrated in FIG. 14, each output mouth 25 of the hopper 24 comprises a plurality of dividing walls 31 defining channels 32, each configured to contain a vertical stack of articles 14. Each extractor 29 is configured to extract from the channels 32 of the corresponding output mouth 25 a group of smoking articles 14 and subsequently insert the group of smoking articles 14 into the corresponding forming box 27. As illustrated in FIG. 11, each extractor 29 comprises a plurality of cylindrical rods 33, each separate from and independent of the other cylindrical rods 33 and configured to press against a corresponding single smoking article 14 of the group so as to push the single article 14 out of the respective channel 32 of the output mouth 25 and then insert the single smoking article 14 into a corresponding through hole 28 of the forming box 27. In particular, each extractor 29 comprises a support plate 34 on which cylindrical rods 33 are mounted that protrude in a cantilevered manner from the support plate 34 (namely, they rise perpendicularly from the support plate 34).

The embodiment illustrated in FIGS. 8, 11 and 14 is configured to manufacture the pack 1 illustrated in FIGS. 1-5, wherein, in each group, the smoking articles 14 are arranged on three overlapping layers and are made up of seven, six and seven cigarettes, respectively; in this embodiment, the cylindrical rods 33 of each extractor 29 are arranged in (exactly) three overlapping rows in order to extract three overlapping layers of smoking articles 14 from the channels 32 of the corresponding output mouth 25. In particular, the cylindrical rods 33 of two end rows are vertically aligned with one another whereas the cylindrical rods 33 of a central row arranged between the two end rows are vertically staggered relative to the cylindrical rods 33 of the two end rows (obviously reproducing the arrangement of the smoking articles 14 in a group of smoking articles 14).

The cylindrical rods 33 of the two end rows are arranged so that two vertically aligned cylindrical rods 33 of the two end rows engage the same channel 32*a* of the output mouth 25 to extract two different smoking articles 14 from the channel 32*a*; in particular, the cylindrical rods 33 of the two end rows are arranged so that two vertically aligned cylindrical rods 33 of the two end rows engage the same channel 32*a* of the output mouth 25 in order to extract, from the channel 32*a*, two different smoking articles 14 that are not adjacent, namely, separated from one another by a further smoking article 14 that is not engaged by the cylindrical rods 33 of the extractor 29. Instead, the cylindrical rods 33 of the central row are arranged so that each channel 32*b* of the output mouth 25 arranged between two channels 32*a* is engaged by a single cylindrical rod 33 of the central row in order to extract a single smoking article 14 from the channel 32*b*. Then, with each extraction of a group of smoking articles 14, two non-adjacent smoking articles 14 are extracted from each channel 32*a*, whereas a single smoking article 14 is extracted from each channel 32*b*; consequently, the extraction of the smoking articles 14 from the channels 32*a* is double compared to the extraction of the smoking articles 14 from the channels 32*b*. To balance this difference, each channel 32*b* has, at the bottom, a filling element 35 which reduces the height of the channel 32*b* relative to a height of the channels 32*a*; namely, each channel 32*b* has, at the bottom, a filling element 35 which defines a lower wall of the channel 32*b*, that is arranged at a higher position than the lower walls of the channels 32*a*.

Figure 6:
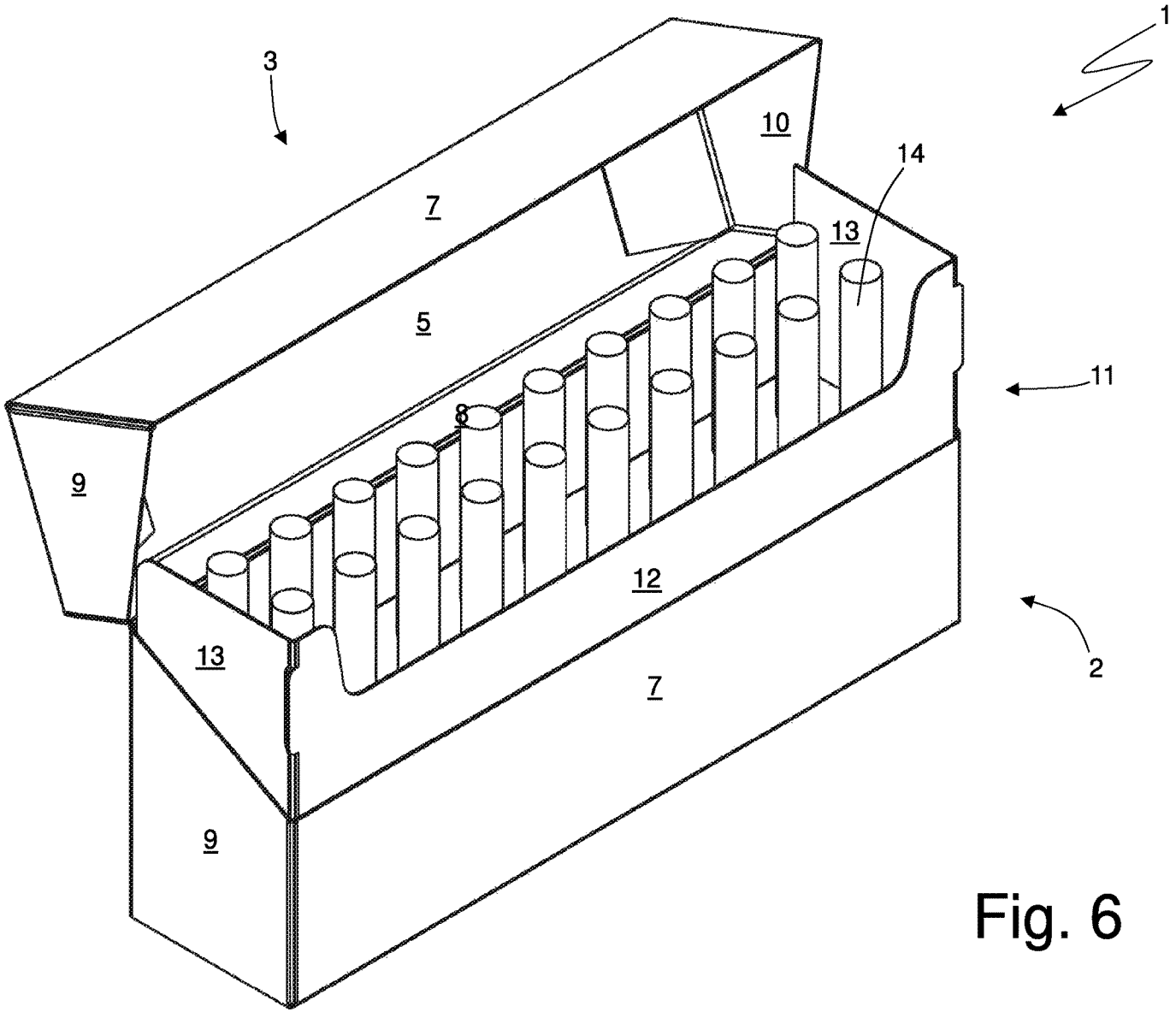
FIG. 6 is a front perspective view of an alternative of the pack of FIG. 1 in an open configuration.
Figure 15:
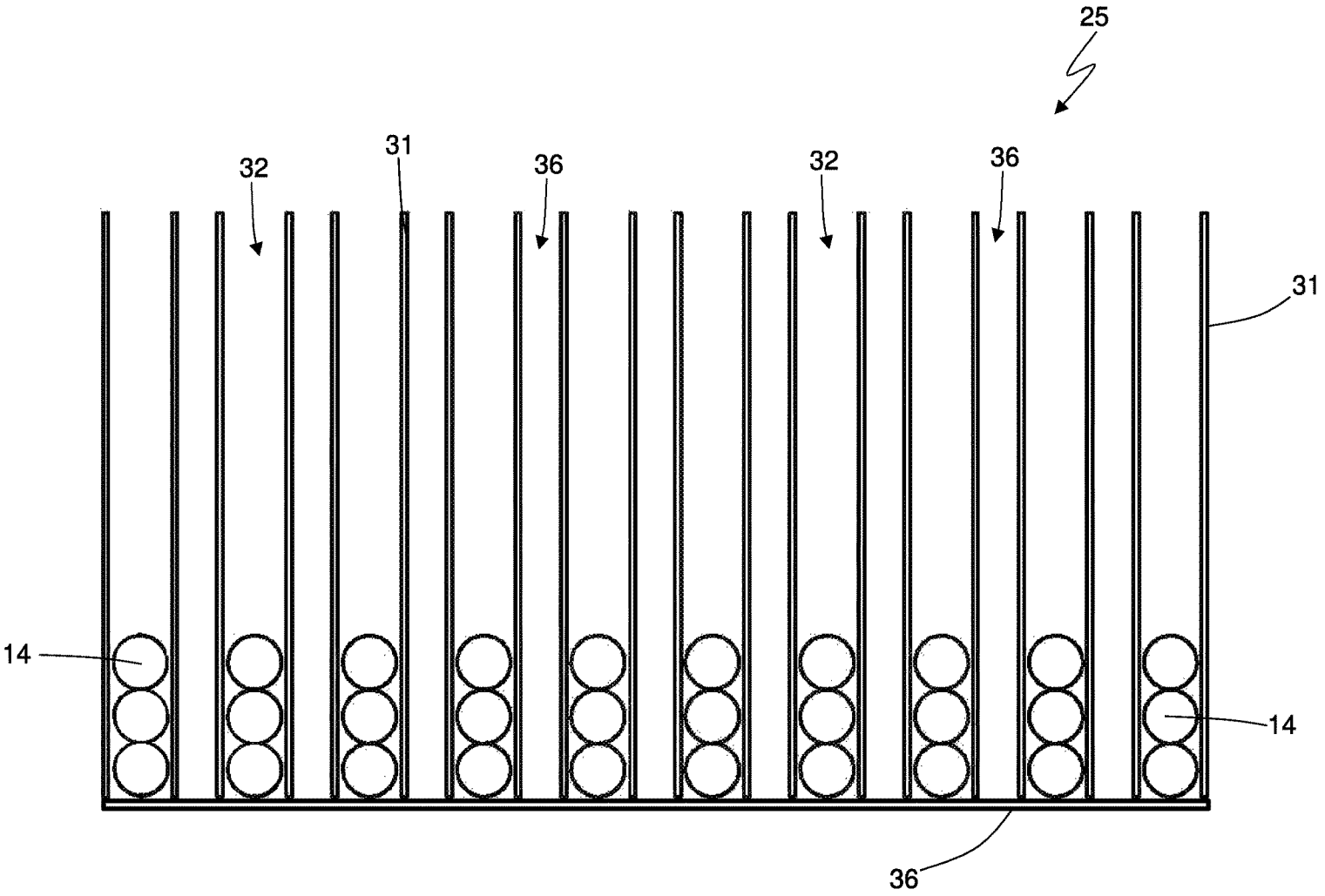
FIG. 15 is a front view of an alternative of the output mouth of FIG. 14.

The embodiment illustrated in FIG. 15 is configured to manufacture the pack 1 illustrated in FIG. 6, wherein, in each group, the smoking articles 14 are arranged on two layers each made up of ten smoking articles 14. In this embodiment, the cylindrical rods 33 of each extractor 29 are arranged in (only) two mutually overlapping rows in order to extract two overlapping layers of smoking articles 14 from the channels 32 of the output mouth 25. The cylindrical rods 33 of each extractor 29 are arranged so that each channel 32 is engaged by two different cylindrical rods 33 vertically aligned with one another in order to extract two different smoking articles 14 from the channel 32; in particular, the cylindrical rods 33 of each extractor 29 are arranged so that each channel 32 is engaged by two different cylindrical rods 33 vertically aligned with one another in order to extract from the channel 32 two different smoking articles 14 that are not adjacent, namely separated from one another by a further smoking article 14 that is not engaged by the cylindrical rods 33 of the extractor 29. Furthermore, in this embodiment, an empty space 36 is provided between two side-by-side channels 32 of the output mouth 25, which separates the two channels 32, namely, each channel 32 is delimited by two dividing walls 31 which are different from and independent of the dividing walls 31 of the other channels 32.

Figure 16:
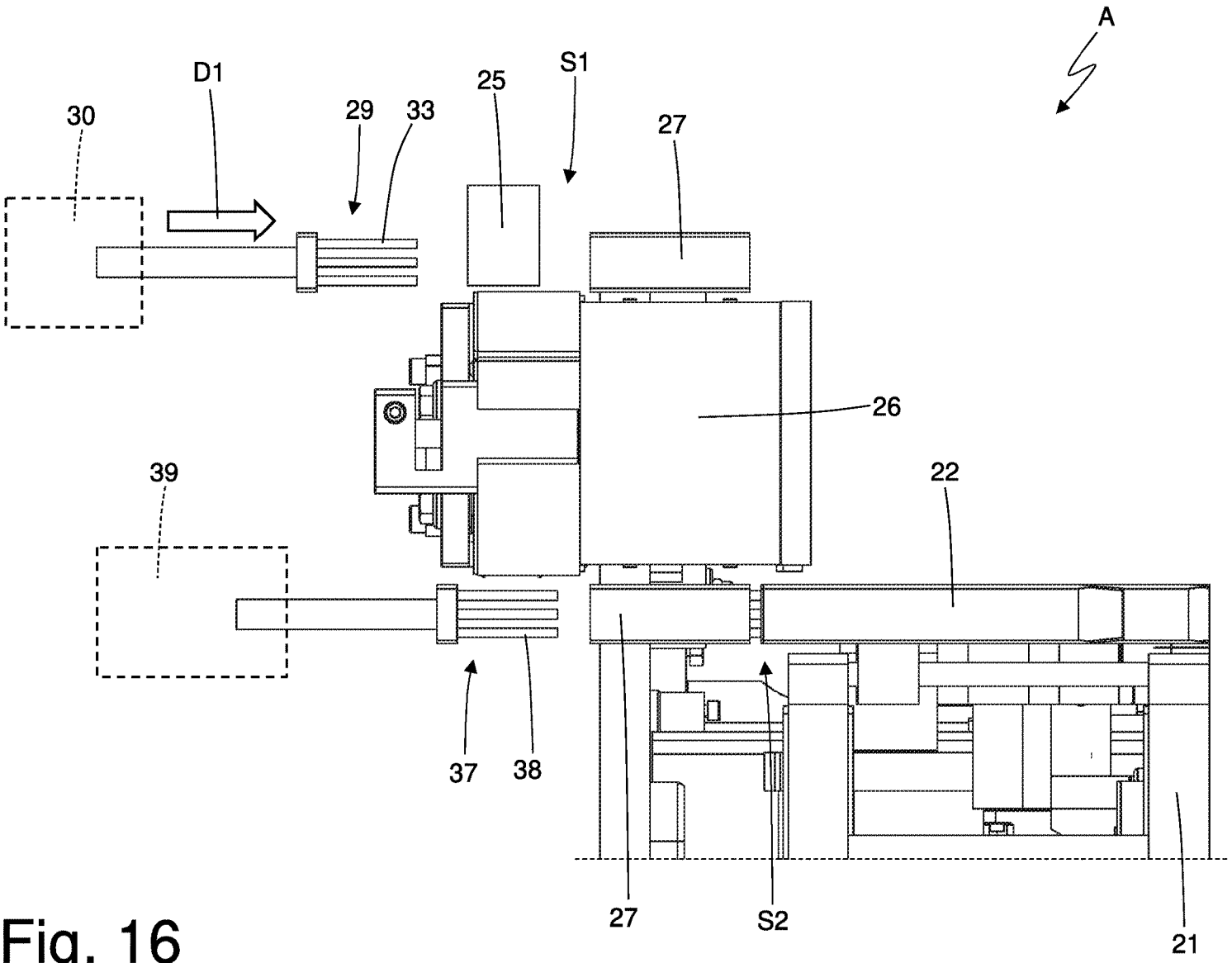
FIG. 16 is a side view and with the elimination of parts for clarity of the forming unit of FIG. 8.

As illustrated in FIG. 16, three transfer units 37 are arranged in the transfer station S2 (only one of which is illustrated in FIG. 16), which are similarly shaped to the extractors 29 and therefore are each provided with a group of cylindrical rods 38 completely identical to the cylindrical rods 33 of the extractors 29. In particular, each transfer unit 37 comprises a support plate on which the cylindrical rods 38 that projects in a cantilevered manner from the support plate (namely, which rise perpendicularly from the support plate) are mounted. The transfer units 37 are moved by an actuator device 39 that is configured to impart to the transfer units 37 both a movement perpendicular to the paths P1 and P2 (namely, along the extraction direction D1), which transfers the smoking articles 14 from the through holes 28 of the forming boxes 27 to the through holes 23 of the wrapping boxes 22, and a movement parallel to the paths P1 and P2 to follow in a synchronized way the movement of the boxes 22 and 27. In fact, the wrapping conveyor 21 preferably has a continuous law of motion, namely, it moves the wrapping boxes 22 along the wrapping path P1 at a constant speed without alternating stopping steps and motion steps; consequently, the transfer units 37 must also move parallel to the paths P1 and P2 in order to remain aligned with the boxes 22 and 27 during the whole transfer step.

According to a preferred embodiment, the forming conveyor 26 has an intermittent law of motion, namely, it moves the forming boxes 27 by alternating stopping steps and motion steps: during a stopping step a group of three forming boxes 27 is still in the input station S1 to receive three groups of smoking articles 14 from the three output mouths 25 of the hopper 24 (which is obviously still), while during a subsequent movement step a group of three forming boxes 27 moves in a synchronized manner with the wrapping conveyor 21 to transfer its own three groups of smoking articles 14 to three wrapping boxes 22 of the wrapping conveyor 21 (which is in continuous movement). The particular law of intermittent motion of the forming conveyor 26, which allows the forming conveyor 26 to interface both with a part of the packing machine 19, which has an intermittent operation (the hopper 24), and with a part of the packing machine 19, which has a continuous operation (the wrapping conveyor 21), is described in greater detail in patent application WO2020089754A1.

Figure 17:
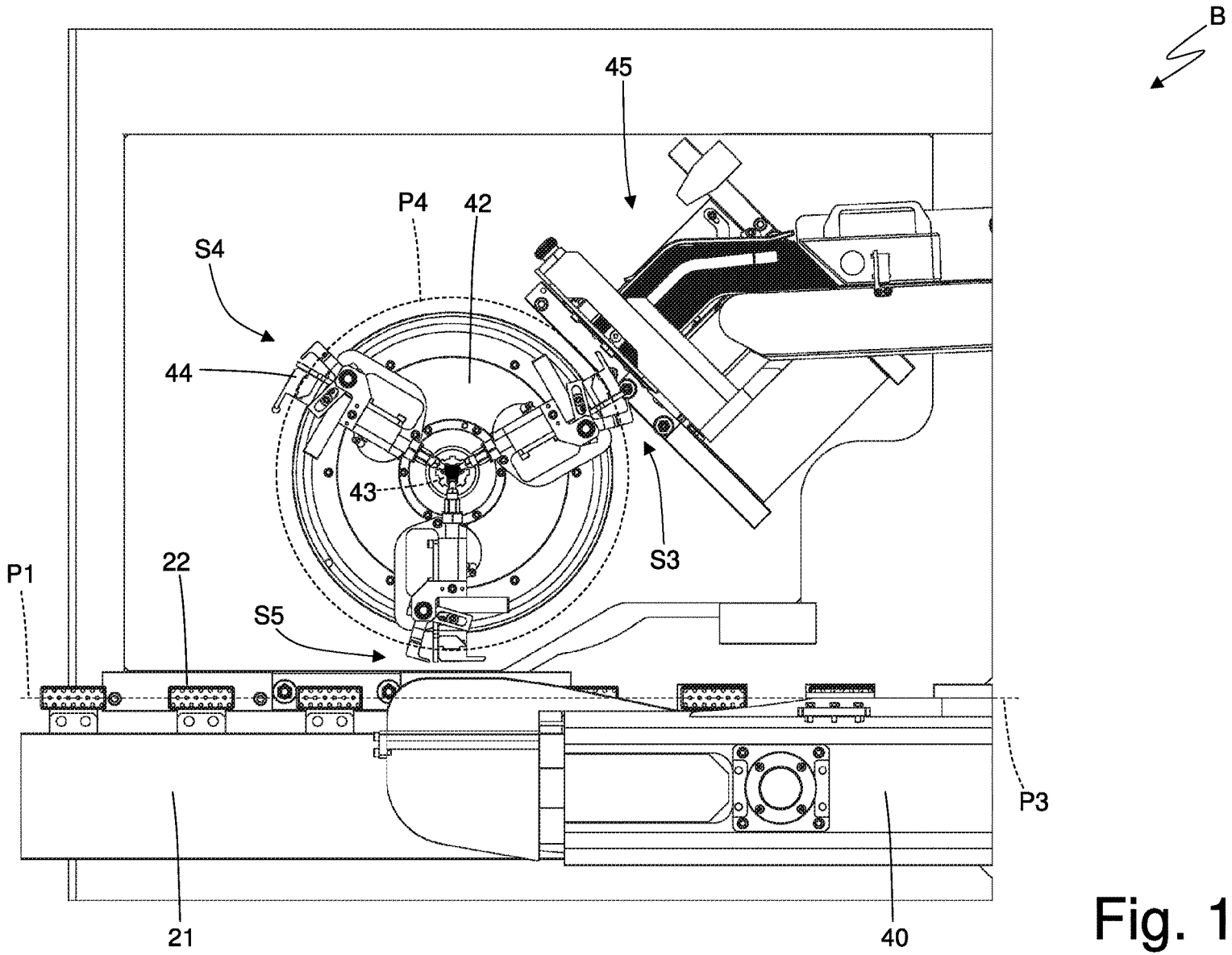
FIG. 17 is a front view and with the elimination of parts for clarity of a wrapping unit of the packing machine of FIG. 7.
Figure 18:
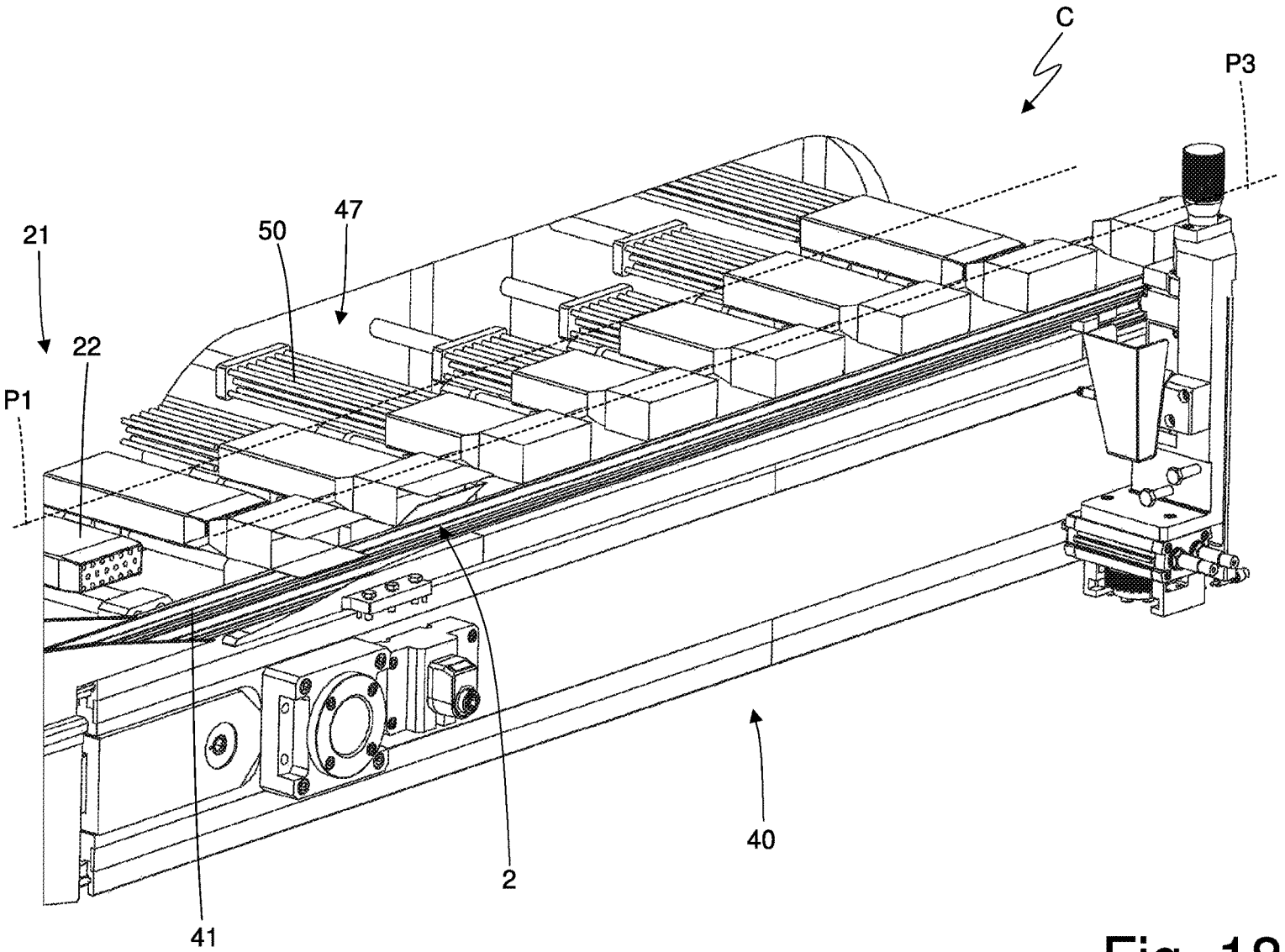
FIG. 18 is a perspective view and with the elimination of parts for clarity of an insertion unit of the packing machine of FIG. 7.

As illustrated in FIGS. 17 and 18, the wrapping unit B comprises a wrapping conveyor 40, which moves, along a rectilinear wrapping path P3 and parallel to the wrapping path P1, a plurality of wrapping pockets 41 each designed to support a container 22 having an open end, namely, as previously mentioned, having the lid 3 in the opening position in order to allow a group of smoking articles 14 to enter. According to a preferred embodiment illustrated in the attached figures, the wrapping conveyor 40 is a belt conveyor and comprises a conveyor belt which is looped around a pair of end pulleys and supports the wrapping pockets 41.

As illustrated in FIG. 17, the wrapping unit B comprises a wrapping wheel 42 which is rotably mounted with continuous motion around a horizontal rotation axis 43 (therefore perpendicular to the plane of FIG. 17 and perpendicular to the paths P1 and P2) and supports three gripping heads 44. The rotation of the wrapping wheel 42 about the rotation axis 43 moves each gripping head 44 along a wrapping path P4 which crosses a gripping station S3 where the gripping head 44 grips a pre-folded blank from a horizontal hopper 45, a folding station S4 where the gripping head 44 folds the blank to form a container 2 having the lid 3 in the opening position, and finally through a release station S5 where the gripping head 44 feeds the container 2, having the lid 3 in the opening position, into a corresponding wrapping pocket 41.

Figure 19:
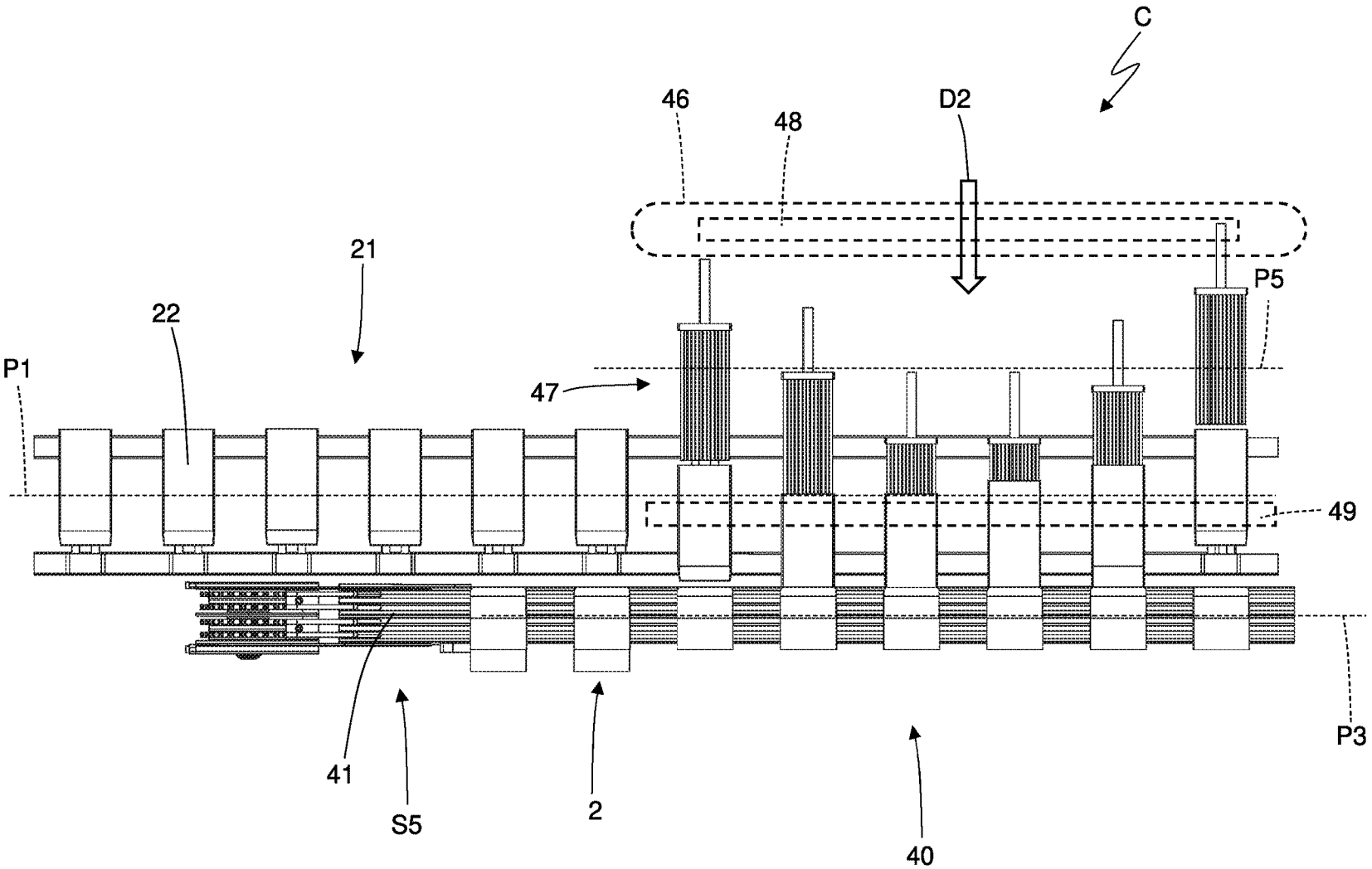
FIG. 19 is a plan view of the insertion unit of FIG. 18.

As illustrated in FIGS. 18 and 19, in the insertion unit C the two wrapping conveyors 21 and 40 move in a parallel and synchronized manner (namely, with the same speed and the same relative position) so that each wrapping box 22 of the wrapping conveyor 21 is always aligned (centred) with a corresponding wrapping pocket 41 of the wrapping conveyor 40. In this way, a group of smoking articles 14 can be transferred by axial movement from a wrapping box 22 of the wrapping conveyor 21 to a container 2 carried by a wrapping pocket 41 of the wrapping conveyor 40.

The insertion unit C comprises a conveyor 46 that moves along a path (P5), which is parallel to and alongside the wrapping path P1 (therefore also parallel to the wrapping path P3) a plurality of pushers 47, each configured to axially push a group of smoking articles 14 out of a corresponding wrapping box 22 of the wrapping conveyor 21 and subsequently inside a container 2 carried by a wrapping pocket 41 of the wrapping conveyor 40. According to a preferred embodiment illustrated in the attached figures, the conveyor 46 is a belt conveyor and comprises a conveyor belt which is looped around a pair of end pulleys and supports the pushers 47.

The insertion unit C comprises an actuator device 48 which is coupled to the conveyor 46 and is configured to move each pusher 47 along a push direction D2 perpendicular to the path P5 (therefore perpendicular to the wrapping paths P1 and P3) in order to push a group of smoking articles 14 out of a wrapping box 22 of the wrapping conveyor 21 and then into a container 2 carried by a wrapping pocket 41 of the wrapping conveyor 40. Preferably, the actuator device 48 uses cams to generate the movement along the push direction D2 by exploiting the movement along the path P5; in this way it is ensured that the movement of the pushers 47 along the push direction D2 generated by the actuator device 48 is always perfectly synchronized with the movement of the pushers 47 along the path P5.

Each wrapping box 22 is mounted in a movable manner on the wrapping conveyor 21 to move with respect to the wrapping conveyor 21 along the push direction D2 which is horizontal and perpendicular to the paths P1, P3 and P5; furthermore, the insertion unit C comprises an actuator device 49 which is configured to move each wrapping box 22 along the push direction D2 so as to insert the wrapping box 22 into the container 2 carried by a corresponding wrapping pocket 41 of the wrapping conveyor 40 before the corresponding pusher 47 pushes the group of smoking articles 14 from the wrapping box 22 of the wrapping conveyor 21 into the container 2 carried by the wrapping pocket 41 of the wrapping conveyor 40. Preferably, the actuator device 49 uses cams to generate movement along the push direction D2 by exploiting the movement along the wrapping path P1; in this way it is ensured that the movement of the wrapping boxes 22 along the push direction D2 generated by the actuator device 49 is always perfectly synchronized with the movement of the wrapping boxes 22 along the wrapping path P1.

The actuator device 49 is configured to keep each wrapping box 22 inside the container 2 carried by the corresponding wrapping pocket 41 of the wrapping conveyor 40 until the corresponding pusher 47 has completely extracted the group of smoking articles 14 from the wrapping box 22. Furthermore, the actuator device 49 is configured to keep each pusher 47 in an end-of-stroke position along the push direction D2 until the actuator device 49 has completely disengaged the group of smoking articles 14 from the corresponding wrapping box 22, moving away the wrapping box 22 from the container 2 carried by the corresponding wrapping pocket 41 of the wrapping conveyor 40; in this way, the return movement of the wrapping box 22 (namely, the moving away of the wrapping box 22 from the container 2 carried by the corresponding wrapping pocket 41) cannot cause an undesired movement due to friction of the smoking articles 14 which are inside the container 2 and are kept in the correct position by the contrast provided by the pusher 47. In other words, the actuator device 48 is configured to start a return stroke of each pusher 47 moving away from the container 2 carried by the corresponding wrapping pocket 41 of the wrapping conveyor 40 only after the actuator device 49 has already started a return stroke of the corresponding wrapping box 22 moving away from the container 2.

As previously stated, each container 2 comprises on the inside thereof two containment walls 16 and 17 that have a plurality of through holes 18 which are engaged by the smoking articles 14; each pusher 47 is configured to insert each smoking article 14 into the corresponding through holes 18 of the containment walls 16 and 17. According to a preferred embodiment, the actuator device 49 is configured to bring each wrapping box 22 in abutment against the upper containment wall 16 inside the container 2 carried by the corresponding wrapping pocket 41 of the wrapping conveyor 40; namely, each wrapping box 22 rests on the upper containment wall 16 inside the container 2 carried by the corresponding wrapping pocket 41 of the wrapping conveyor 40.

As previously stated, each wrapping box 22 comprises a plurality of cylindrical-shaped through holes 23, each being separate from and independent of the other through holes 23 and being designed to house a corresponding single smoking article 14 of the group; each pusher 47 comprises a plurality of cylindrical rods 50, each being separate from and independent of the other cylindrical rods 50 and being designed to press against a corresponding single smoking article 14 of the group so as to push the single smoking article 14 out of the respective through hole 23 of a wrapping box 22 and then insert the single smoking article 14 into the corresponding through holes 18 of the containment walls 16 and 17 of a container 2 carried by a corresponding wrapping pocket 41 of the wrapping conveyor 40 (namely, each cylindrical rod 50 is designed to pass through a corresponding through hole 23 of a wrapping box 22). In particular, each pusher 47 comprises a support plate on which the cylindrical rods 50 are mounted that project in a cantilevered manner from the support plate (namely, they rise in a perpendicular manner from the support plate).

As better illustrated in FIG. 10, each wrapping box 22 has a front portion having a tapered shape which enters first inside a container 2; in this way, each wrapping box 22 is self-centring relative to the container 2, namely, it is able to autonomously correct small positioning inaccuracies of the container 2 due to the construction tolerances of the blanks and to the tolerances of the wrapping process.

As previously stated, the conveyors 21, 40 and 46 have the same law of continuous motion; to ensure perfect synchronism of the movements of the conveyors 21, 40 and 46, preferably the conveyors 21, 40 and 46 are driven by the same common motor.

It is important to note that the packing machine 19 could comprise the forming unit A described above combined with a different type of wrapping unit B and/or a different type of insertion unit C; namely, the particular conformation of the forming unit A can be exploited independently of the presence or absence of the other units B, C and D described above. Similarly, the packing machine 19 could comprise the insertion unit C described above combined with a different type of forming unit A and/or with a different type of wrapping unit B; namely, the particular conformation of the insertion unit C can be exploited independently of the presence or absence of the other units A, B and D described above.

The embodiment illustrated in the attached figures refers to the production of a rigid pack 1 of rod-shaped smoking articles, but the present invention can also be applied without substantial modifications to the production of any other type of rigid pack of articles, even if not rod-shaped smoking articles (or in any case having a substantially longitudinal development such as containers of the pharmaceutical or cosmetic field).

The embodiments described here can be combined with one another without departing from the scope of protection of the present invention.

The formation unit A described above has numerous advantages, as it allows to form the groups of articles 14 in an effective way (that is, by forming only complete groups and without running the risk of damaging the articles 14) and efficiently (that is, at a high operating speed and indicatively higher than 300-400 groups of articles 14 per minute). Furthermore, the formation unit A described above is relatively simple and compact to implement.

The insertion unit C described above has numerous advantages, since it allows the groups of articles 14 to be inserted into the open containers 2 in an effective way (that is, by inserting all the articles 14 into the corresponding through holes 18 of the containment walls 16 and 17 for containing the containers without damaging either the articles 14 or the containers 2) and efficiently (that is, at a high operating speed and indicatively higher than 300-400 packs 1 per minute). Furthermore, the insertion unit C described above is relatively simple and compact to implement.

LIST OF REFERENCE NUMBERS OF THE FIGURES

1 pack
2 container
3 lid
4 hinge
5 upper wall
6 lower wall
7 front wall
8 rear wall
9 side wall
10 side wall
11 collar

12 front wall
13 side walls
14 smoking articles
15 support system
16 containment wall
17 containment wall
18 holes
19 packing machine
20 frame
21 wrapping conveyor
22 wrapping box
23 through holes
24 hopper
25 output mouth
26 forming conveyor
27 forming box
28 through holes
29 extractors
30 actuator device
31 dividing walls
32 channels
33 cylindrical rods
34 support plate
35 filling element
36 empty space
37 transfer units
38 cylindrical rods
39 actuator device
40 wrapping conveyor
41 wrapping pocket
42 wrapping wheel
43 rotation axis
44 gripping heads
45 hopper
46 conveyor
47 pusher
48 actuator device
49 actuator device
50 cylindrical rods
A forming unit
B wrapping unit
C insertion unit
D closing unit
P1 wrapping path
P2 forming path
P3 wrapping path
P4 wrapping path
P5 path
D1 extraction direction
D2 push direction
S1 input station
S2 transfer station
S3 gripping station
S4 folding station
S4 release station

The invention claimed is:

1. A forming unit (A) to manufacture a group of articles (14), wherein the articles (14) are arranged at a given distance from one another; the forming unit (A) comprises a forming conveyor (26), which moves a plurality of forming boxes (27) each designed to support a group of smoking articles (14) along a forming path (P2); a hopper (24), which is arranged in an input station (S1) along the forming path (P2) and is provided with at least one output mouth (25) comprising a plurality of dividing walls (31) defining channels (32), each configured to contain a vertical stack of articles (14);

an extractor (29), which is configured to extract the group of articles (14) from the channels (32) of the output mouth (25) and to insert, in the input station (S1), the group into a corresponding forming box (27) of the forming conveyor (26) by means of a work stroke, which is perpendicular to the forming path (P2);

a wrapping conveyor (21), which moves along a straight and horizontal wrapping path (P1) a plurality of wrapping boxes (22) each designed to support a group of smoking articles (14); and a transfer station (S2) in which the groups of smoking articles (14) are transferred from the corresponding forming boxes (27) of the forming conveyor (26) to corresponding wrapping boxes (22) of the wrapping conveyor (21);

wherein each forming box (27) of the forming conveyor (26) comprises a plurality of through holes (28) with a cylindrical shape, each being separate from and independent of the other through holes (28) and being designed to house a corresponding single article (14) of the group.

2. The forming unit (A) according to claim 1, wherein the extractor (29) comprises a plurality of cylindrical rods (33), each being separate from and independent of the other cylindrical rods (33) and being configured to press against a corresponding single article (14) of the group so as to push the single article (14) out of the respective channel (32) of the output mouth (25) and, hence, insert the single article (14) into a corresponding through hole (28) of the forming box (27).

3. The forming unit (A) according to claim 2, wherein the cylindrical rods (33) of the extractor (29) are arranged in at least two overlapping rows in order to extract two overlapping layers of articles (14) from the channels (32) of the output mouth (25).

4. The forming unit (A) according to claim 3, wherein the cylindrical rods (33) of the extractor (29) are arranged so that at least one same channel (32) is engaged by two different cylindrical rods (33) vertically aligned with one another in order to extract two different articles (14) from the channel (32).

5. The forming unit (A) according to claim 3, wherein the cylindrical rods (33) of the extractor (29) are arranged so that at least one same channel (32) is engaged by two different cylindrical rods (33) vertically aligned with one another and arranged in order to extract, from the channel (32), two different articles (14), which are not adjacent to one another, namely are separated from one another by a further article (14), which is not engaged by the cylindrical rods (33) of the extractor (29).

6. The forming unit (A) according to claim 3, wherein between two side-by-side channels (32) of the output mouth (25) there is an empty space (36), which separates the two channels (32).

7. The forming unit (A) according to claim 2, wherein the cylindrical rods (33) of the extractor (29) are arranged in three overlapping rows in order to extract three overlapping layers of articles (14) from the channels (32) of the output mouth (25).

8. The forming unit (A) according to claim 7, wherein the cylindrical rods (33) of two end rows are vertically aligned with one another, whereas the cylindrical rods (33) of a central row arranged between the two end rows are vertically staggered relative to the cylindrical rods (33) of the two end rows.

9. The forming unit (A) according to claim 8, wherein the cylindrical rods (33) of the two end rows are arranged so that two vertically aligned cylindrical rods (33) of the two end rows engage a same first channel (32*a*) of the output mouth (25) in order to extract two different articles (14) from the first channel (32*a*).

10. The forming unit (A) according to claim 8, wherein the cylindrical rods (33) of the two end rows are arranged so that two vertically aligned cylindrical rods (33) of the two end rows engage a same first channel (32*a*) of the output mouth (25) in order to extract, from the first channel (32*a*), two different articles (14), which are not adjacent to one another, namely, are separated from one another by a further article (14), which is not engaged by the cylindrical rods (33) of the extractor (29).

11. The forming unit (A) according to claim 8, wherein the cylindrical rods (33) of the extractor (29) are arranged so that each second channel (32*b*) of the output mouth (25) arranged between two first channels (32*a*) is engaged by a single cylindrical rod (33) of the central row in order to extract one single article (14) from the second channel (32*b*).

12. The forming unit (A) according to claim 11, wherein each second channel (32*b*) has, at the bottom, a filling element (35), which reduces the height of the second channel (32*b*) relative to a height of the first channels (32*a*).

13. The forming unit (A) according to claim 11, wherein each second channel (32*b*) has, at the bottom, a filling element (35), which defines a lower wall of the second channel (32*b*) arranged higher than the lower walls of the first channels (32*a*).

14. A forming method to manufacture a group of articles, wherein the articles (14) are arranged at a given distance from one another; the forming method comprises the steps of:

moving, by means of a forming conveyor (26), a plurality of forming boxes (27) each designed to support a group of smoking articles (14) along a forming path (P2);

feeding a mass of articles (14) to a hopper (24), which is arranged in an input station (S1) along the forming path (P2) and is provided with at least one output mouth (25) comprising a plurality of dividing walls (31) defining channels (32), each configured to contain a vertical stack of articles (14);

extracting the group of articles (14) from the channels (32) of the output mouth (25) and inserting, in the input station (S1), the group into a corresponding forming box (27) of the forming conveyor (26) causing an extractor (29) to cover a work stroke, which is perpendicular to the forming path (P2);

moving, by means of a wrapping conveyor (21), along a straight and horizontal wrapping path (P1) a plurality of wrapping boxes (22) each designed to support a group of smoking articles (14); and transferring, in a transfer station (S2), the groups of smoking articles (14) from the corresponding forming boxes (27) of the forming conveyor (26) to corresponding wrapping boxes (22) of the wrapping conveyor (21);

wherein each forming box (27) of the forming conveyor (26) comprises a plurality of through holes (28) with a cylindrical shape, each being separate from and independent of the other through holes (28) and being designed to house a corresponding single article (14) of the group.

* * * * *